United States Patent [19]

Tanaka et al.

[11] Patent Number: 4,906,954

[45] Date of Patent: Mar. 6, 1990

[54] DIRECTIONAL COUPLER DEVICE

[75] Inventors: Toshiaki Tanaka, Yokosuka; Masayoshi Aikawa, Takarazuka, both of Japan

[73] Assignee: ATR Optical and Radio Communications Research Laboratories, Kyoto, Japan

[21] Appl. No.: 254,499

[22] PCT Filed: May 30, 1988

[86] PCT No.: PCT/JP88/00526

§ 371 Date: Aug. 31, 1988

§ 102(e) Date: Aug. 31, 1988

[87] PCT Pub. No.: WO88/09568

PCT Pub. Date: Dec. 1, 1988

[30] Foreign Application Priority Data

May 29, 1987 [JP] Japan ..... 62-136726
Aug. 13, 1987 [JP] Japan ..... 62-203309
Aug. 17, 1987 [JP] Japan ..... 62-203676

[51] Int. Cl.[4] ..... H01P 5/18
[52] U.S. Cl. ..... 333/116; 330/295
[58] Field of Search ..... 333/109, 116; 330/286, 330/295

[56] References Cited

U.S. PATENT DOCUMENTS 3,575,674 4/1971 Howe, Jr. ..... 333/116
3,748,601 7/1973 Seidel ..... 333/109

FOREIGN PATENT DOCUMENTS 1192001 11/1985 U.S.S.R. ..... 333/116

*Primary Examiner*—Paul Gensler
*Attorney, Agent, or Firm*—Birch, Stewart, Kolasch & Birch

[57] ABSTRACT

The present invention relates to a multi terminal directional coupler combined by a plurality of directional couplers. Two directional coupling conductors form each of the directional couplers and are provided on both side faces of a ground conductor through dielectric substrates so as to oppose each other. Openings are defined on the ground conductor corresponding to the coupling conductors so that the coupling conductors are electrically coupled through the openings. Therefore, interference between transmission lines situated on both sides of the ground conductor can be prevented and the multi terminal directional coupler can be made small in size and weight.

6 Claims, 24 Drawing Sheets

CONVENTIONAL ART

DIRECTIONAL COUPLER DEVICE

FIELD OF THE INVENTION

The present invention relates to a directional coupler device.

DESCRIPTION OF THE PRIOR ART

FIG. 3 shows a circuit diagram for a multi terminal directional coupler having four input terminals and four output terminals. In FIG. 3, the signals input to signal input terminals 1 and 2 are inputted to a hybrid directional coupler 9*a* having a 3 dB degree of coupling (referred to as coupling degree hereinafter) and each of the signals is divided into two parts by the directional coupler 9*a* and the divided signals are coupled. The divided and coupled signals are respectively input to hybrid directional couplers 9*c* and 9*d*. The signals input to the signal input terminals 3 and 4 are inputted to a hybrid directional coupler 9*b* having a 3 dB coupling degree and each signal is divided into two parts by the directional coupler 9*b* and each signal is coupled. The divided and coupled signals are input to the hybrid directional couplers 9*c* and 9*d* having a 3 dB coupling degree. The signals input in the directional couple 9*c* are respectively divided in two parts and the signals are coupled. The divided and coupled signals are output at signal output terminals 5 and 6. The signals input in the directional coupler 9*d* are respectively divided into two parts and the signals are coupled. The divided and coupled signals are output at the signal output terminals 7 and 8.

In the multi terminal directional coupler constructed as mentioned above, each signal has $\frac{1}{4}$ power of the input power of the signals input in the input terminals 1 to 4 and each signal is output at the output terminals 5 to 8. The multi terminal directional coupler can be applied to a butler matrix which controls the direction of the radiation beam and the available scope of the coupler is wide.

In FIGS. 4(A) and 4(B), there is provided a branch line directional coupler 9*a* on the top surface of the left upper portion of a dielectric substrate 10 which is formed in a rectangular shape having a ground conductor plate 11 formed on the entire reverse surface of the substrate 10. The branch line directional couple 9*a* includes strip conductors 21 and 22 having a rectangular shape of a width d1 and a length $\lambda g/4$ and strip conductors 23 and 24 having a rectangular shape of a width d2 and a length $\lambda g/4$. The strip conductors 21 and 22 and the strip conductors 23 and 24 are respectively formed in parallel on the dielectric substrate 10 for providing the respective strip conductors 21 to 24 in a rectangular shape. $\lambda g$ is a wave length in the wave guide. Respective conductors on the connection point of the strip conductors 21 and 23, the connection point of the strip conductors 22 and 24, and the connection point of the strip conductors 21 and 24 are respectively indicated by the numeral 25 to 28. As known in the prior art, in the branch line directional coupler 9*a*, a microwave line of a specific impedance $Z_0$ may be coupled to the conductors 25 to 28 by suitably defining the widths d1 and d2 of the strip conductors 21 to 24 for obtaining a 3 db coupling degree in a circuit formed by the conductors 25 to 28 of the connection points.

Branch line directional couplers 9*b*, 9*c*, and 9*d* are formed on the left bottom portion, the right top portion, and the right bottom portion of the top surface of the insulator substrate 10, as shown in FIG. 4(A). Branch line directional couplers 9*b*, 9*c*, and 9*d* are similar to the branch line directional coupler 9*a*. For convenience, reference numerals 21 to 29 of the directional coupler 9*a* are used in the directional couplers 9*b*, 9*c*, and 9*d*.

The respective conductors 25, 26, 27, and 28 at the connection points of the directional coupler 9*a* are connected to the signal input terminals 1 and 2. The connection points 25 of the respective directional couplers 9*c* and 9*d* are connected thereto through the connection strip conductors 31, 32, 35, and 36, having width d. The respective conductors 25, 26, 27, and 28 at the connection points of the direction coupler 9*b* are connected to the signal input terminals 3 and 4. The connection points 26 of the respective directional couplers 9*c* and 9*d* are connected thereto through the connection strip conductors 33, 34, 37, and 38 having the width d. It is noted that the strip conductors 36 and 37 are formed in solid crossing shape, that is, the conductor 37 is laid over the conductor 36 which has an insulator 43 formed in between at a solid cross portion 30. The conductors 28 and 27 at the connection points of the directional couple 9*c* are respectively connected to the signal output terminals 5 and 6 through the strip conductors 39 and 40. The conductors 28 and 27 at the connection points of the directional coupler 9*d* are respectively connected to the signal output terminals 7 and 8 through the strip conductors 41 and 42. In order to transfer $\frac{1}{4}$ power of the signals input in the signal input terminals 1 to 4 to the output terminals 5 to 8 with a predetermined phase difference, the respective lengths of the connection strip conductors 31 to 34, 35 to 38, and 39 to 42 are made equal.

In the multi terminal directional coupler, constructed as mentioned, the connection strip conductors 31 to 42 act as micro strip lines in association with the ground conductor 11 and operate in a similar manner as the directional coupler shown in FIG. 3. When the specific impedance of the micro strip line is given, the width of the strip conductors 31 to 42 can be selected in a known manner.

In the conventional directional coupler, as shown in FIGS. 4(A) and 4(B), the signal which propogates along the strip conductor 36 and the signal which propogates along the strip conductor 36 and the signal which propogates along the strip conductor 37 interfere each other at the cross point 30 of the connection strip conductors 36 and 37. Whereby, equivalent signals cannot be produced at the signal output terminals 5 to 8.

In the multi terminal directional coupler, the electrical length of the signals which propogate the connection strip conductors 31, 35 and 39; 32, 36, and 41; 33, 37, and 40; 34, 38, and 42 from the terminals 1 to 4 to the signal output terminals 5 to 8 are required to coincide. However, in the conventional structure, as shown in FIGS. 4(A) and 4(B), it is necessary to adjust the length of the strip conductors 31 to 42 to correspond with the shape of the solid crossing 30, which makes manufacturing of the coupler difficult.

Furthermore, in order to decrease the electrical coupling among the connection strip conductors 31 to 42 other than the hybrid couplers 9*a* to 9*d*, it is necessary to make the line distance widths equal. However, in the conventional structure shown in FIG. 4, there must be provided eight input and output strip conductors 31 to 34 and 39 to 42 and four strip conductors 35 to 38 for connecting the directional couplers on the substrate 10, whereby the size of the directional coupler is bulky.

The present invention is made for solving the various problems mentioned above by providing directional coupler device which is able to prevent interference of the signals propogating in the strip conductors and to divide the power of the input signal with a good electrical property.

A further object of the present invention is to provide a directional coupler device which is light in weight, compact, and can be manufactured easily.

SUMMARY OF THE INVENTION

The present invention is characterized in that a plurality of first directional couplers are formed on two opposite faces of a ground conductor through dielectric substrates, and two connection conductors are formed on the two opposite faces of the ground conductor through the dielectric substrates. Thereby, an opening is defined in the ground conductor and a plurality of second directional couplers are provided for connecting the conductors.

In the second directional couplers, arranged as mentioned above, the signals on the two connection conductors can be mode-coupled through the opening of the ground conductor. Whereby, the two directional couplers can operate similarly to the conventional branch line directional coupler, as shown in FIGS. 4(A) and 4(B). When first and second micro strip lines formed on the dielectric substrate with two terminals are connected to the connection conductors, the first and second micro strip lines can be coupled by the second directional coupler. Under this condition, a microwave signal input to one signal input terminal of the microstrip line passes the connection conductor of the directional coupler and is output either at another signal terminal of the first microstrip line and at another signal terminal of the second microstrip line. The connection conductor is connected to the first microstrip line. The opening of the ground conductor and the connection conductor are connected to the second microstrip line. A microwave signal input to one signal terminal of the second microstrip line is output at another signal terminal of the first microstrip line in a similar manner, as mentioned above.

In the first directional coupler, which is known as a branch line, interdigit or tandem directional couplers are provided on both faces of the ground conductor through the dielectric substrate and the second directional coupler is connected to the first directional coupler. Whereby, a multi directional coupler having a plurality of input and output terminals may be provided.

Accordingly, the first directional couple can divide each of the input signals. The divided input signals can be coupled and output at the second directional coupler. Subsequently, the second directional coupler divides each of the input signals and couples the divided input signals and outputs. For example, assuming that the multi terminal directional coupler includes two first directional couplers and two second directional couplers with the coupling degree of the first and second directional couplers being 3 db. In a similar manner to the device shown in FIGS. 4(A) and 4(B), the second directional couple outputs $\frac{1}{4}$ power of the input signal that this input to the first directional coupler.

As mentioned above, since the first directional coupler is provided on the opposite faces of the ground conductor through the dielectric substrate, while the connection conductor of the second directional coupler is provided on the dielectric substrate, it is possible to make a multi terminal directional coupler $\frac{1}{2}$ size of the conventional directional coupler and it is not necessary to provide the solid crossing. Accordingly, it is possible to form accurate conductor patterns and to prevent interference of the signals at the solid crossing which occurs in the conventional directional coupler.

Furthermore, the present invention is characterized in that a multi terminal directional couple includes N input terminals, wherein N is $2^l$ with N being more than 4 and is a natural number, N output terminals and $1\times2^{l-1}$ directional couplers for outputting signals having 1/N power from the input signals which are input to the N input terminals. Each of the $1\times2^{l-1}$ directional couplers is formed in such a manner that two coupling conductors forming the output or input terminals are formed on two opposite sides of a ground conductor through dielectric substrates and two opposite coupling conductors are electromagnetically coupled through an opening defined in the ground conductor.

By the arrangement mentioned above, strip conductors for connecting the input terminals, the output terminals, coupling conductors of the directional couplers, the respective terminals and coupling conductors, and the respective conductors can be separated formed on the respective dielectric substrates situated on both sides of the multi terminal directional coupler may be decreased to about $\frac{3}{8}$ of the conventional directional coupler. Whereby, it is possible to decrease the size and weight of the directional coupler. Moreover, since the solid crossing can be eliminated, it is possible to prevent the interference between the signals propogating in the strip conductors. Therefore, multi terminal directional couplers can be provided which are able to divide the power of the input signals with a good electrical property.

Moreover, according to the present invention, there is provided a microwave signal processing circuit which includes a directional coupler formed in such a manner that a pair of coupling conductors forming input and output terminals are formed on both sides of a ground conductor through substrates. Thereby, the coupling conductors are electromagnetically coupled through an opening defined on a ground conductor formed between the coupling conductors and the microwave signal processing circuit disposed on the substrates connected at the front stage or the rear stage of the directional coupler.

In the arrangement mentioned above, the coupling conductors of the directional coupler, the microwave signal processing circuits, the connecting lines for connecting the coupling conductors, and the microwave signal processing circuits may be divided in two parts on both sides of the two substrates. Accordingly, the size of the microwave device can be decreased by $\frac{1}{2}$, as compared to the conventional device and it is possible to decrease the size and weight of the microwave device. In additional, since the device, according to the present invention, can be made without ridge coupling, as used in the conventional device, it is possible to prevent the interference between the signals propogating in the various circuits or lines of the device. Therefore, there can be provided microwave devices which can process the input signals with a good electric property.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Referring to FIGS. 1(A) to 1(D), there are defined coupling openings **17*a* and 17*b* which penetrate a ground conductor 11 and have a length W on the short side and a length λg/4 on the long side in the upper right portion and the lower right portion of an elongated ground conductor 11 which has a thickness of t0. The coupling openings 17*a* and 17*b* are filled with coupling insulation materials 10*ca* and 10*cb*. The ground conductor 11 is provided between dielectric substrates 10*a* and 10*b*** which have thickness of t.

In the upper right portion of FIG. 1(A) above the dielectric substrate **10*a*, a coupling conductor 18*a* of a rectangular shape with a length S on the short side and a length λg/4 on the along side is formed above the coupling insulation material 10*ca*. On the other hand, another coupling conductor 19*a*, similar to the conductor 18*a*, is formed below the coupling insulation material 10*ca* in the upper left portion of FIG. 1(B) on the lower surface of the dielectric substrate 10*b*. In order to provide input terminals and output terminals of the multi terminal directional coupler on the same side and to equalize the electric length between the input terminals and the output terminals, the coupling conductors 18*a* and 19*a* are formed so that the longitudinal directions of the coupling conductors 18*a* and 19*a* extend in a parallel direction to the longitudinal direction of the dielectric substrates 10***a* and 10*b*. When a microwave signal is applied to the ends of the short sides of the coupling conductors 18*a* and 19*a*, there is developed a mode coupling between the coupling conductors 18*a* and 18*b* and the ground conductor 11 through the coupling insulation material 10*ca* in the coupling opening 17*a*. Then, the input power is divided into two equivalent parts and the input power is coupled. Thereby, the power is output at the other end of the short side of each of the coupling conductors 18*a* and 19*a*.

Referring to FIGS. 1(A) and 1(B), the positions of the coupling openings 17*a* and 17*b* are indicated by the dotted lines. The respective short sides of the coupling opening 17*a* of the ground conductor 11 and the short sides of the coupling conductors 18*a* and 19*a* coincide with each other. The dielectric substrates 10*a* and 10*b* and the coupling insulation material 10*ca* are formed in one body having the same dielectric constant.

Figure 1:
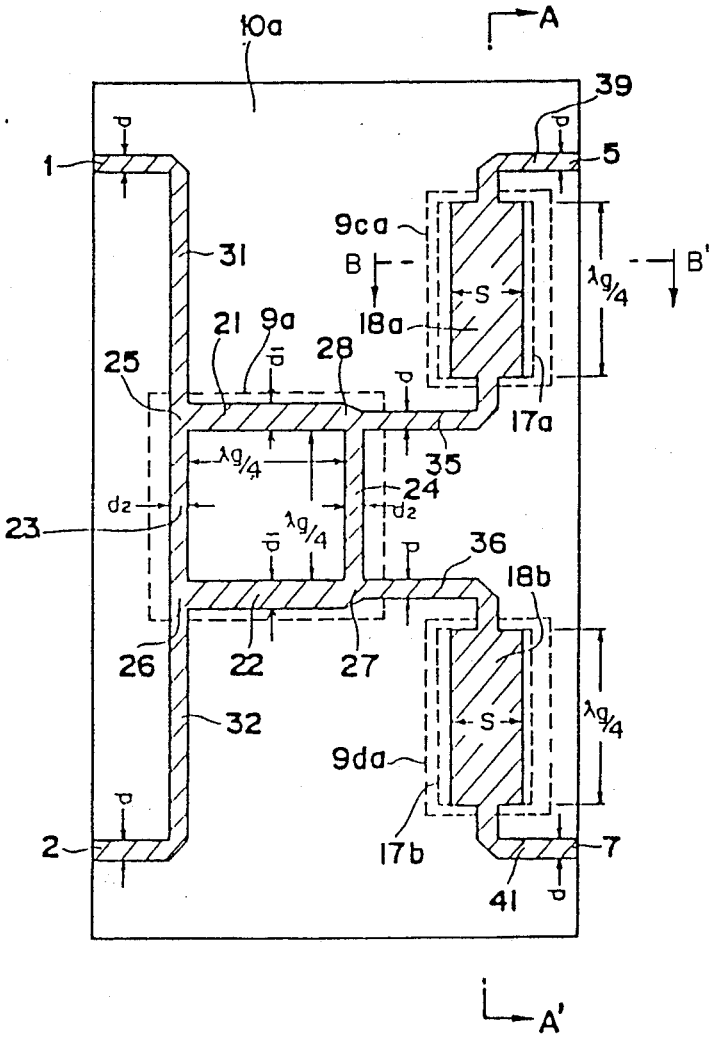
FIG. 1(A) is a top plan view showing an example of a four input and four output directional coupler according to an embodiment of the present invention.
FIG. 1(B) is a plan view showing the directional coupler of FIG. 1(A), as viewed from below.
FIG. 1(C) is a top plan view showing a ground conductor used in the directional coupler of FIG. 1(A)
FIG. 1(D) is a cross sectional view taken along the line A—A′ of FIG. 1(A) and FIG. 1(B)
Figure 1:
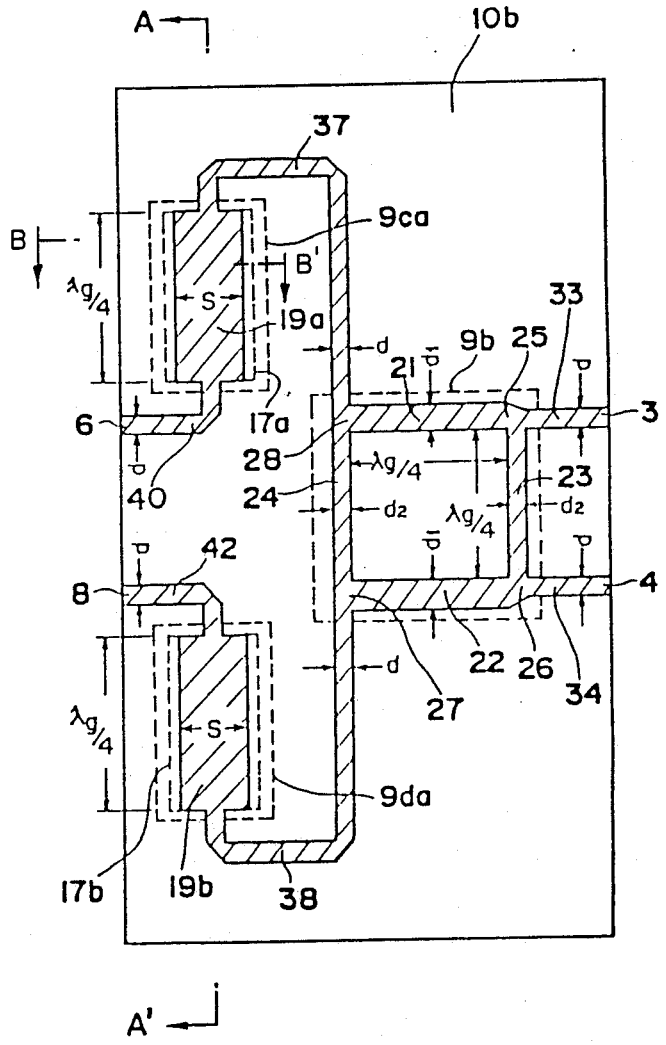
Figure 1C:
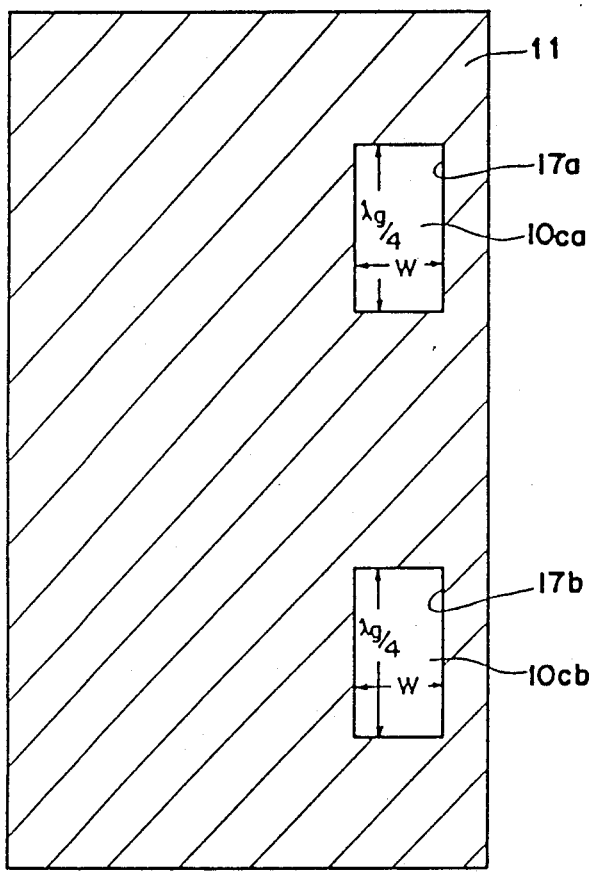
Figure 1D:
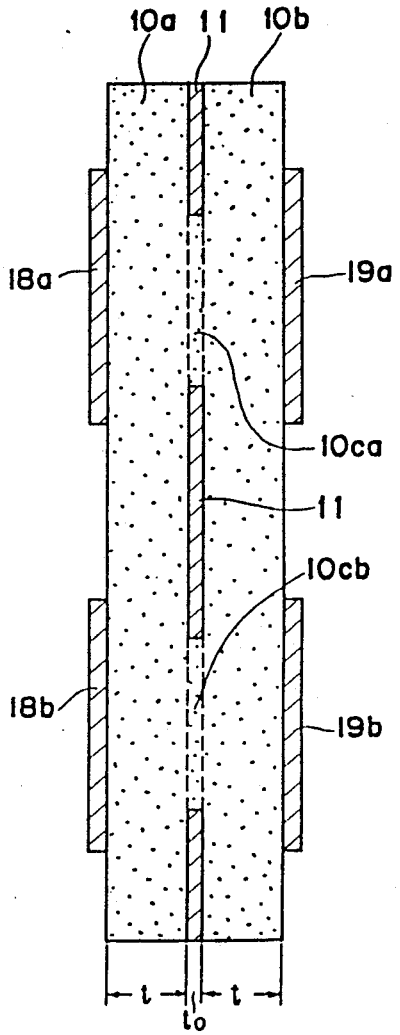
Figure 2:
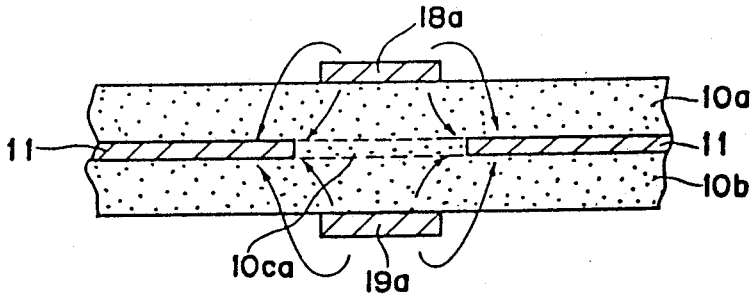
FIGS. 2(A) and 2(B) are vertical cross sectional views showing an electric field distribution for even and odd modes in a vertical mode drive at the connecting portion of the line B—B′ of FIGS. 1(A) and 1(B)
Figure 2:
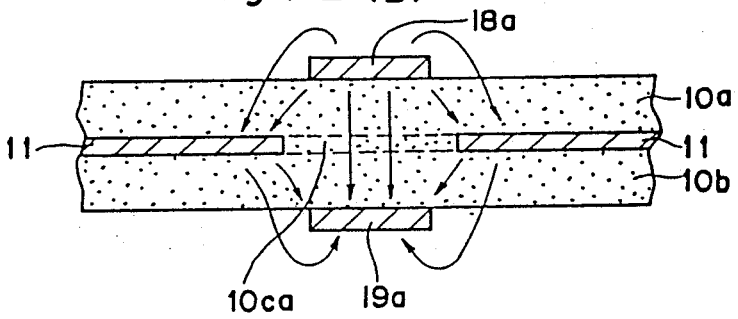

FIGS. 2(A) and 2(B) are respectively vertical cross sectional views showing the electric field distribution of the odd mode an the even mode by the known vertical mode driving at the coupling portion on the B—B′ line of FIGS. 1(A) and 1(B). In the even mode, which is shown in FIGS. 2(A), electric force lines are developed between the coupling conductors 18*a* and 19*a* and the ground conductor 11, whereby the opening acts as a magnetic wall. On the other hand, in the odd mode, which is shown in FIG. 2(B), electric force lines are developed between the coupling conductors 18*a* and 19*a* and the ground conductor 11, whereby the opening acts as an electric wall.

Accordingly, a directional coupler 9*ca* is formed having a predetermined coupling degree by the ground conductor 11 and the coupling conductors 18*a* and 19*a* are formed on the dielectric substrates 10*a* and 10*b*. Therefore, a four terminal directional coupler 9*ca* may be provided having a coupling degree of 3 dB by selecting the dielectric constant of the dielectric substrate 10*a*, the width S of the coupling conductors 18*a* and 19*a*, and the width W of the coupling opening 17*a*. It is noted that the coupling degree is 3 dB. In order to increase the coupling degree, the width W of the coupling opening 17*a* is made large.

There is formed a coupling conductor 18*b* having the same shape of the conductor 18*a* directly above the coupling insulation material 10*cb* in the lower right portion in FIG. 1(A) on the dielectric substrate 10*a*. Also, a coupling conductor 19*b* is formed having the same shape as the conductor 19*a* directly below the coupling insulation material 10*cy* in the lower left portion of FIG. 1(B) on the lower surface of the dielectric substrate 10*b*. Accordingly, there can be provided a directional coupler 9*da* having a 3 dB coupling degree in a similar manner as the directional coupler 9*ca* using the ground conductor 11 and the coupling conductors 18*b* and 19*b*.

There is formed a branch line directional coupler 9*a* having a 3 dB coupling degree similar to a conventional coupler at the central portion of FIG. 1(A) on the upper surface of the dielectric substrate 10*a*. Another branch line directional coupler 9*b* having a 3 dB coupling degree similar to a conventional coupler is formed at the central portion of FIG. 1(B) on the lower surface of the dielectric substrate 10*b*.

On the upper surface of the dielectric substrate 10*a*, the signal input terminals 1 and 2 are connected to the conductors 25 and 26 disposed at the connection points of the directional coupler 9*a* through connection strip conductors 31 and 32 having a width of d. The connection conductors 27 and 28 of the directional coupler 9*a* are connected on the lower end of the short side of the coupling conductor 18*a* of the directional coupler 9*ca* and the short side of the coupling conductor 18*b* of the directional coupler 9*da* through connecting strip conductors 36 and 35. The upper end portion of the short side of the coupling conductor 18*a* of the directional coupler 9*ca* and the lower end portion of the short side of the coupling conductor 18*b* of the directional coupler 9*da* are connected to the signal output terminals 5 and 7 through connecting strip conductors 39 and 41.

On the lower surface of the dielectric substrate 10*b*, the signal input terminals 3 and 4 are connected to conductors 25 and 26 at the connection point of the directional coupler 9*b* through the connection strip conductors 33 and 34 having a width of d. Conductors 27 and 28 at the connecting point of the directional coupler 9*b* are connected to the upper end portion on the short side of the coupling conductor 19*a* of the directional coupler 9*ca* and the lower end portion on the short side of the coupling conductor 19*b* of the directional coupler 9*da* through the connection strip conductors 38 and 37 having a width of d. The lower end portion on the short side of the coupling conductor 19*a* of the directional coupler 9*ca* and the upper end portion on the short side of the coupling conductor 19*b* of the directional coupler 9*da* are connected to the signal output terminals 6 and 8 through the connection strip conductors 40 and 42. In the arrangement mentioned above, the signal input terminals 1 and 2 and the signal output terminals 5 and 7 are formed on the outer parts of the left and right side of the dielectric substrate 10*a*. The signal input terminals 3 and 4 and the signal output terminals 6 and 8 are formed on the outer parts of the left and right sides of the dielectric substrate 10*b*. Therefore, when lead wires are connected to the signal input terminals and the signal output terminals, the connection of the lead wires is easy since the connecting positions do not overlap.

Moreover, in order to transmit ¼ power of the input signals entered at the signal input terminals 1 to 4 to the signal output terminals 5 to 8 with the same phase difference of the input signals, the electric lengths of the parts beginning from the signal input terminals 1 to 4 to the input ends of the respective directional couplers 9*ca* and 9*da* including connection strip conductors 31 and 35, connection strip conductors 32 and 36, connection strip conductors 33 and 37 and connection strip conductors 34 and 38 are equivalent. Also, the electric lengths of the parts beginning from the output ends of the directional couplers 9*ca* and 9*da* including the connection strip conductors 39 to 42 are equivalent.

Figure 3:
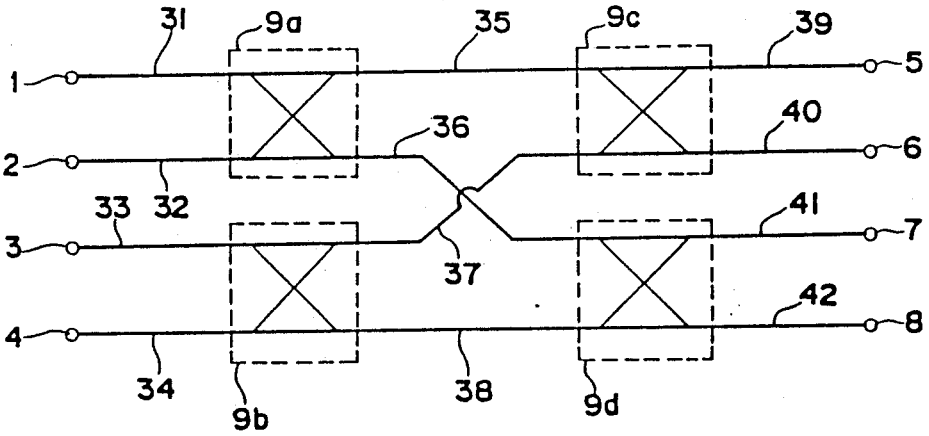
FIG. 3 is a circuit diagram of the four input and four output multi terminal directional coupler of FIGS. 1(A) and 1(B)
Figure 4:
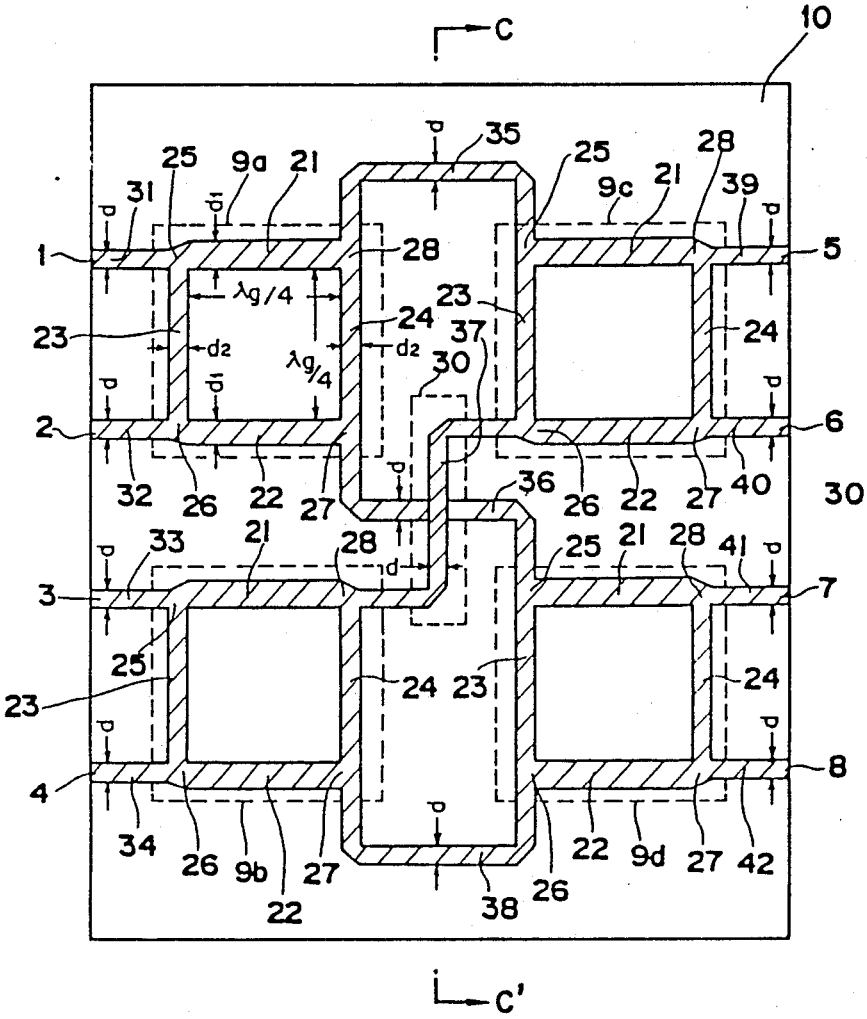
FIG. 4(A) is a top plan view showing a four input and four output multi terminal directional coupler using four branch line directional couplers.
FIG. 4(B) is a vertical cross sectional views taken along the line C—C′ of FIG. 4(A)
Figure 4:
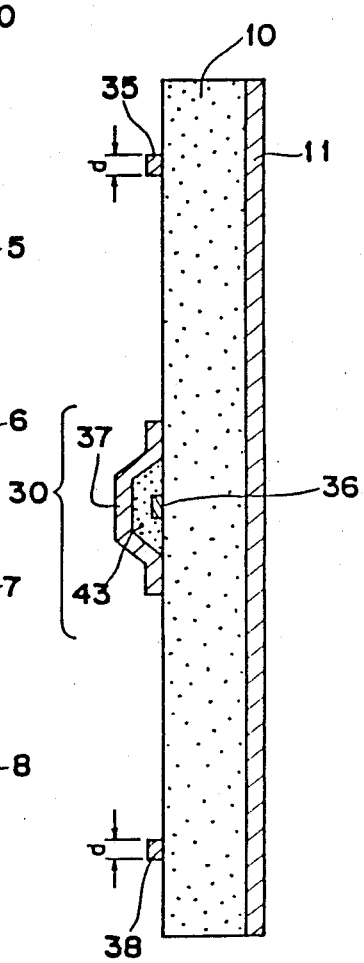
CONVENTIONAL ART Fig. 4 (B)

The multi terminal directional coupler, arranged as mentioned above, has an equivalent circuit to the circuit of FIG. 3 and can act similar to the circuit of FIGS. 4(A) and 4(B). Although in the embodiment mentioned above the terminals 1 to 4 are used as the signal input terminals and the terminals 5 to 8 are used as the signal output terminals, the multi terminal directional coupler can act as a reversible circuit. Therefore, the terminals 1 to 4 can be used as the signal output terminals and the terminals 5 to 8 can be used as the signal input terminals.

In the arrangement shown in the present arrangement, it is possible to decrease the sides of the device to about ½ of the conventional device of FIGS. 4(A) and 4(B). In addition, since the solid crossing part 30 formed by the strip conductors 36 and 37, as shown in FIGS. 4(A) and 4(B) is unnecessary, the input signal can be divided into two parts having equal power and good equivalency. In addition, since the solid crossing part 30 is unnecessary in the present embodiment, it is possible to form the conductor patterns accurately, whereby, the electric lengths between the respective input terminals and output terminals can be made uniformly. Accordingly, an accurate phase relation can be assured between the input terminal an the output terminal.

In the embodiment mentioned above, although the branch line hybrid directional couplers 9*a* and 9*b* are used for dividing and coupling the power of the signal on the same plane, the present invention is not limited to this embodiment. For example, various hybrid directional couplers may be used, such as an interdigit type, and a tandem connection type hybrid directional coupler for dividing and coupling the power of the signal. In this case, it is possible to decrease the sides of the device, as compared to the device using the branch line hybrid directional coupler.

In the embodiment mentioned above, although an explanation is made with respect to the case having four input and four output terminals, the present invention is not limited to this embodiment. The present invention can be applied to the case having multi terminals more than five and there may be arranged such a multi terminal directional coupler having more than three known directional couplers 9*a*, 9*b*, and 9*c*, and more than two directional couplers 9*ca* and 9*da* .

Moreover in the embodiment mentioned above, although the shape of the coupling conductors 18*a*, 18*b*, 19*a*, and 19*b* and the coupling openings 17*a* and 17*b* are rectangular, they are not limited, as shown in this embodiment. It is possible to form the coupling opening for coupling the mode coupling conductors 18*a*, 19*a*, 18*b*, and 19*b*.

In the present invention, there are provided a plurality of first directional couplers on both sides of the ground conductor through the dielectric substrate and two coupling conductors are formed which are connected with the first directional couplers on both sides of the ground conductor through the dielectric substrate. In addition, the ground conductor between the coupling conductors is provided by the opening. Moreover, there are provided the second directional couplers to couple the coupling conductors, whereby the second directional couplers act in a similar manner as the conventional branch line directional couplers as shown in FIGS. 4(A) and 4(B), so that there are provided two known first directional couplers and second directional couplers. Therefore, the multi terminal directional coupler, according to the present invention, can act similar to the conventional directional coupler.

As mentioned above, the first directional couplers are provided on both sides of the ground conductors through the dielectric substrates. The coupling conductors of the second directional coupler are provided on the dielectric substrates and a multi terminal directional coupler having ½ size of the conventional multi terminal directional coupler can be formed to eliminate the solid crossing. Accordingly, the conductor patterns of the directional coupler can be formed accurately, it is advantageous that the signals can be output with a good electric property for preventing the interference of the signals at the solid crossing part.

A further embodiment of the present invention is explained hereinafter.

Referring to FIGS. 5(A), 5(B), 6(A), and 6(B), there are defined coupling openings 52*ax* to 52*dx* which penetrate a ground conductor 11*x* and have a length W on the short side and a length λg/4 on the long side in the upper left portion, the lower left portion, the central portion, and the central right portion of an elongated ground conductor 11*x* having a thickness. The coupling openings 52*ax* to 52*dx* are filled with coupling insulation materials 10*cax*, 10*cbx*, 10*ccx*, and 10*cdx*. The ground conductor 11*x* is provided between dielectric substrates 10*ax* and 10*bx*.

Figure 5A:
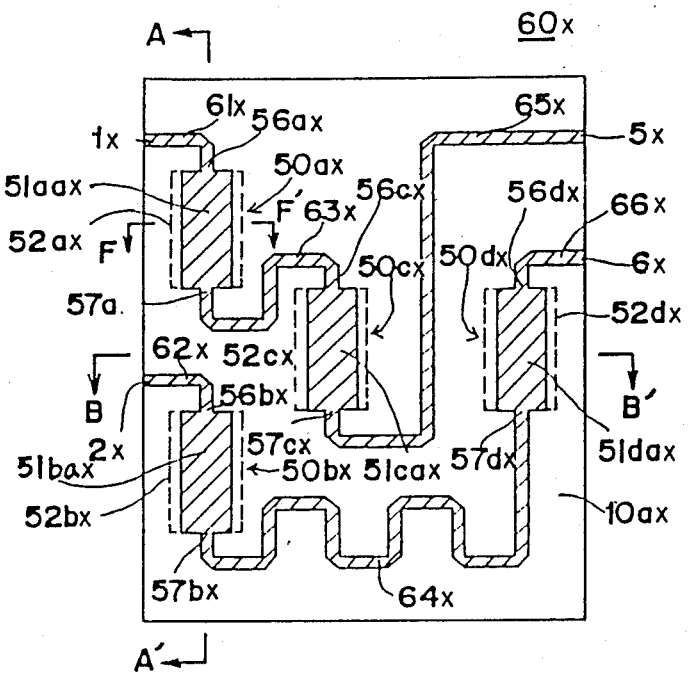
FIG. 5(A) is a top plan view showing an example of the four input and four output multi terminal directional coupler according to another embodiment of FIG. 4(A)

In the upper left portion of FIG. 5(A) above the dielectric substrate 10*ax*, a coupling conductor 51*aax* having a rectangular shape of a length S on the short side and a length λg/4 on the long side is formed above the coupling insulation material 10*cax*. On the other hand, another coupling conductor 51*abx* similar to the conductor 51*aax* is formed below the coupling insulation material 10*cax* on the upper right portion of FIG. 5(B) on the lower surface of the dielectric substrate 10*bx*. In order to provide input terminals and output terminals of the multi terminal directional coupler on the same side and to equalize the electrical length between the input terminal and the output terminal, the coupling conductors 51*aax* and 51*abx* are formed so that the longitudinal directional of the coupling conductors 51*aax* and 51*abx* extend in a parallel direction to the longitudinal direction of the dielectric substrates 10*aax* and 10*abx*. When a microwave signal is applied to the ends of the short sides of the coupling conductors 51*aax* and 51*abx*, there is developed a mode coupling between the coupling conductors 51*aax* and 51*abx* and the ground conductor 11*x* through the coupling insulation material 10*cax* in the coupling opening 52*ax*. Then, the input power is divided into two equivalent parts and the power is coupled. Thereby, power is output at the other end of the short side of each of the coupling conductors 51*aax* and 51*abx*.

Figure 5B:
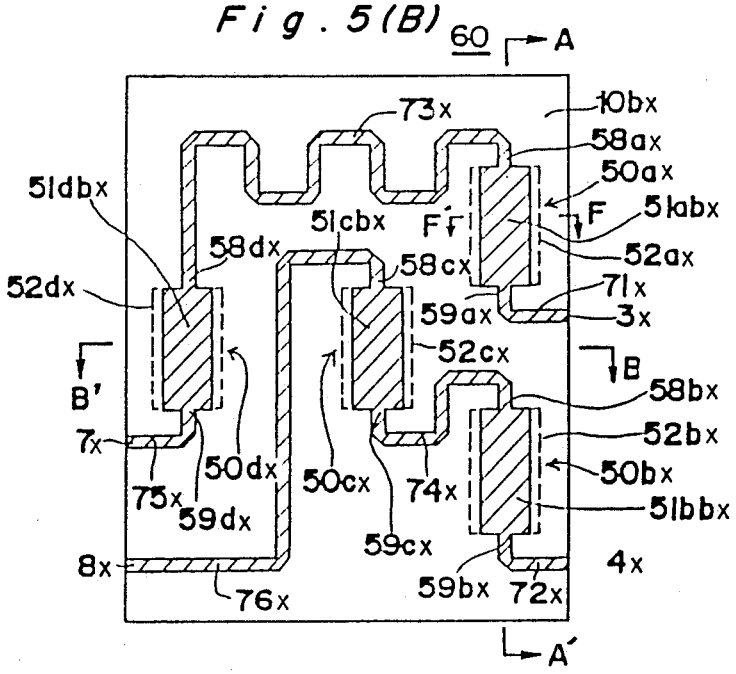
FIG. 5(B) is a bottom plan view of the multi terminal directional coupler of FIG. 5(A)
Figure 5C:
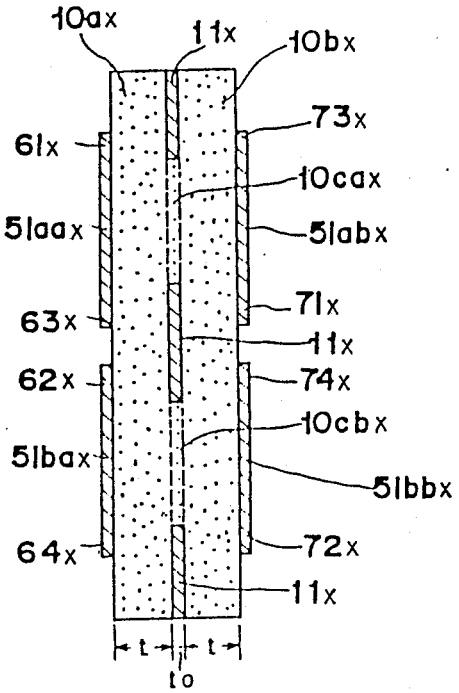
FIG. 5(C) is as vertical cross sectional view taken along the line A—A′ shown in FIGS. 5(A) and 5(B)
Figure 5D:
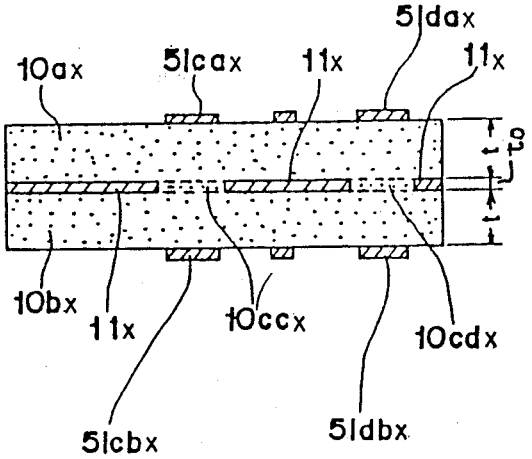
FIG. 5(D) is a vertical cross sectional view taken along the line B—B′ of FIGS. 5(A) and 5(B)

Referring to FIGS. 5(A) and 5(B), the positions of the coupling openings 52*ax* and 52*dx* are indicated by dotted lines. The respective short sides of the coupling opening 52*ax* of the ground conductor 11*x* and the short sides of the coupling conductors 51*aax* and 51*abx* coincide with each other. The dielectric substrates 10*ax* and 10*bx* and coupling insulation material 10*cax* are formed in one body having the same dielectric constant. The same structure may be employed in the directional couplers 50*bx* to 50*dx*.

Figure 10:
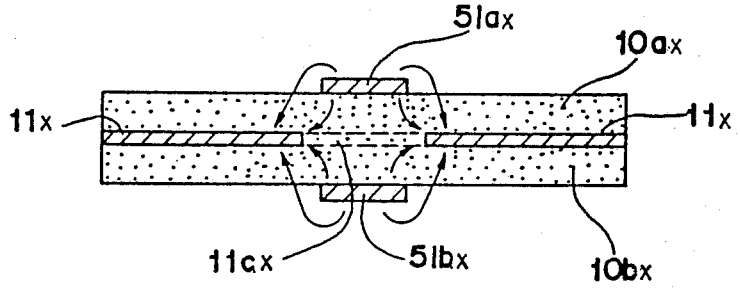
FIGS. 10(A) and 10(B) are vertical cross sectional views for even and odd modes of the vertical mode drive at the connecting portion on the line F—F′ of FIGS. 5(A) and 5(B)
Figure 10:
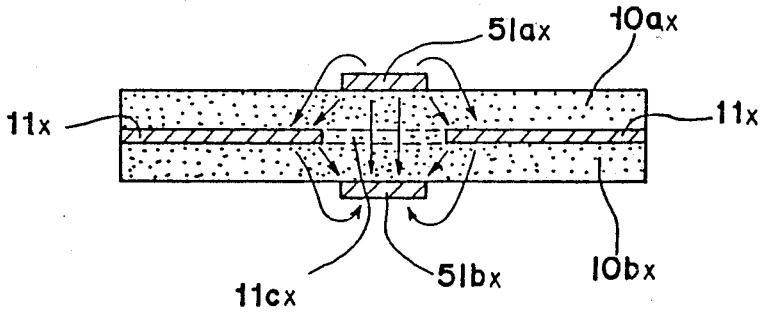
Figure 11:
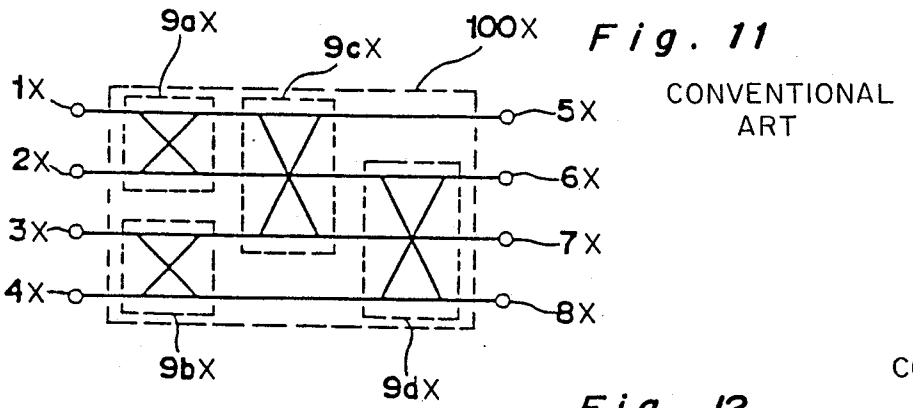
Fig. 11 CONVENTIONAL ART
FIG. 11 is a circuit diagram showing the conventional four input and four output multi terminal directional coupler.

FIGS. 10(A) and 10(B) are respectively vertical cross sectional views showing the electric field distribution of odd and even modes from a known vertical mode driving at the coupling portion on the F—F' line of FIG. 5. In the even mode, which is shown in FIG. 10(A), there are developed electric force lines between the coupling conductors 51*aax* and 51*abx* and the ground conductor 11*x*, whereby, the opening acts as a magnetic wall. On the other hand, in the odd mode, which is shown in FIG. 10(B), there are developed electric force lines between the coupling conductors 51*aax* and 51*abx* and the ground conductor 11*x*, whereby the opening acts as an electric wall.

Accordingly, a directional coupler 50*ax* having a predetermined coupling degree is formed by the ground conductor 11*x* and the coupling conductors 51*aax* and 51*abx* are formed on the dielectric substrates 10*ax* and 10*bx*. Therefore, there can be provided a four terminal directional coupler 50*ax* having a coupling degree of 3 dB by selecting the dielectric constant of the dielectric substrates 10*ax* and 10*bx*, the width S of the coupling conductors 51*aax* and 51*abx* and the width W of the coupling opening 52*ax*. It is noted that the coupling degree is 3 dB. In order to increase the coupling degree, the width W of the coupling opening 52*ax* is made large.

There is formed a coupling conductor 51*bax* having the same shape of the conductor 51*aax* directly above the coupling insulation material 10*cbx* in the lower left portion of FIG. 5(A) on the dielectric substrate 10*ax*. A coupling conductor 51*bbx* having the same shape of the conductor 51*abx* is formed directly below the coupling insulation material 10*cbx* in the lower right portion in FIG. 5(B) on the lower surface of the dielectric substrate 10*bx*. Accordingly, there can be provided a directional coupler 50*bx* having a 3 dB coupling degree in a similar manner as the directional coupler 50*ax* by the ground conductor 11*x* and the coupling conductors 51*bax* and 51*bbx*.

There is formed a coupling conductor 51*cax* having the same shape of the conductor 51*aax* directly above the coupling insulation material 10*cdx* at the right central portion of FIG. 5(A) on the dielectric substrate 10*ax*. A coupling conductor 51*dbx* having the same shape of the conductor 51*abx* is formed directly below the coupling insulation material 10*cdx* at the left central portion of FIG. 5(B) on the lower surface of the dielectric substrate 10*bx*. Accordingly, there can be provided a directional coupler 50*dx* having a 3 dB coupling degree in a similar manner as the directional coupler 50*ax* by the ground conductor 11*x* and the coupling conductors 51*dac* and 51*dbx*.

On the upper surface of the dielectric substrate 10*ax*, the signal input terminal 1*x* is connected to the connection terminal 56*ax* on the upper portion of the coupling conductor 51*aax* of the directional coupler 50*ax* through a connection strip conductor 61*x*. The connection terminal 57*ax* on the lower portion of the coupling conductor 51*aax* of the directional coupler 50*ax* is connected to the connection terminal 56*cx* on the upper portion of the coupling conductor 51*cax* of the directional coupler 50*cx* through a connection strip conductor 63*x* having a S shape. The connection terminal 57*cx* on the lower portion of the coupling conductor 51*cax* of the directional coupler 50*cx* is connected to the signal output terminal 5*x* through the connection strip conductor 65*x*. The signal input terminal 2*x* is connected to the connection terminal 56*bx* on the upper portion of the coupling conductor 51*bax* of the directional coupler 50*bx* through the connection strip conductor 62*x*. The connection terminal 57*bx* on the lower portion of the coupling conductor 51*bax* of the directional coupler 50*bx* is connected to the connection terminal 57*dx* of the coupling conductor 51*dax* of the directional coupler 50*dx* through the connection strip conductor 64*x* having a zigzag shape. The connection terminal 56*dx* in the upper portion of the coupling conductor 51*dax* of the directional coupler 50*dx* is connected to the signal output terminal 6*x* through the connection strip conductor 66*x*.

On the lower surface of the dielectric substrate 10*bx*, the signal input terminal 3*x* is connected to the connection terminal 59*ax* on the lower portion of the coupling conductor 51*abx* of the directional coupler 50*ax* connection terminal 58*ax* in the upper portion of the coupling conductor 51*abx* of the directional coupler 50*ax* is connected to the connection terminal 58*dx* in the upper portion of the coupling conductor 51*dbx* of the directional coupler 50*dx* through the connection strip conductor 73*x* having a zigzag shape. The connection terminal 59*bx* in the lower portion of the coupling conductor 51*dbx* of the directional couple 50*dbx* is connected to the signal output terminal 7*x* through the connection strip conductor 75*x*. The signal input terminal 4*x* is connected to the connection terminal 59*bx* in the lower portion of the coupling conductor 51*bbx* of the directional coupler 50*bx* through the connection strip conductor 72*x*. The connection terminal 58*dx* on the upper portion of the coupling conductor 51*bbx* of the directional coupler 50*bx* is connected to the connection terminal 59*cx* in the lower portion of the coupling conductor 51*cbx* of the directional coupler 50*cx* through the connection strip conductor 74*x* having an S shape. The connection terminal 58*cx* in the upper portion of the coupling conductor 51*cbx* of the directional coupler 50*cx* is connected to the signal output terminal 8*x* through the connection strip conductor 76*x*.

The width of the respective connection strip conductors 61*x* to 66*x* and 71*x* to 76*x* are defined according to the characteristic impedance.

As shown in FIGS. 5(A) and 5(B), the signal input terminals 1*x* to 4*x* and the signal output terminals 5*x* to 8*x* are formed so that they are located alternatively on the dielectric substrates 10*ax* and 10*bx* with the different position of one side of the dielectric substrates 10*ax* and 10*bx*. Accordingly, in order to connect a lead wire to the respective signal input and output terminals 1*x* to 8*x*, the respective connection points do not overlap so that the work connection is easy. In order to output a signal having $\frac{1}{4}$ power of the input signal applied to the signal input terminals 1*x* to 4*x* at the respective output terminals 5*x* to 8*x* with the same phase difference, the electric length of the connection strip conductor beginning from the respective signal input terminals 1*x* to 4*x* and ending at the signal output terminals 5*x* to 8*x* through the respective directional couplers. That is, the electric length is the total electric length of the connection strip conductors 61*x*, 63*x* and 65*x*; the total electric length of the connection strip conductors 62*x*, 64*x* and 66*x*; the total electric length of the connection strip conductors 71*x*, 73*x* and 75*x*; and the total electric length of the connection strip conductors 72*x*, 74*x* and 76*x* are made uniform.

Figures 14A, 14B:
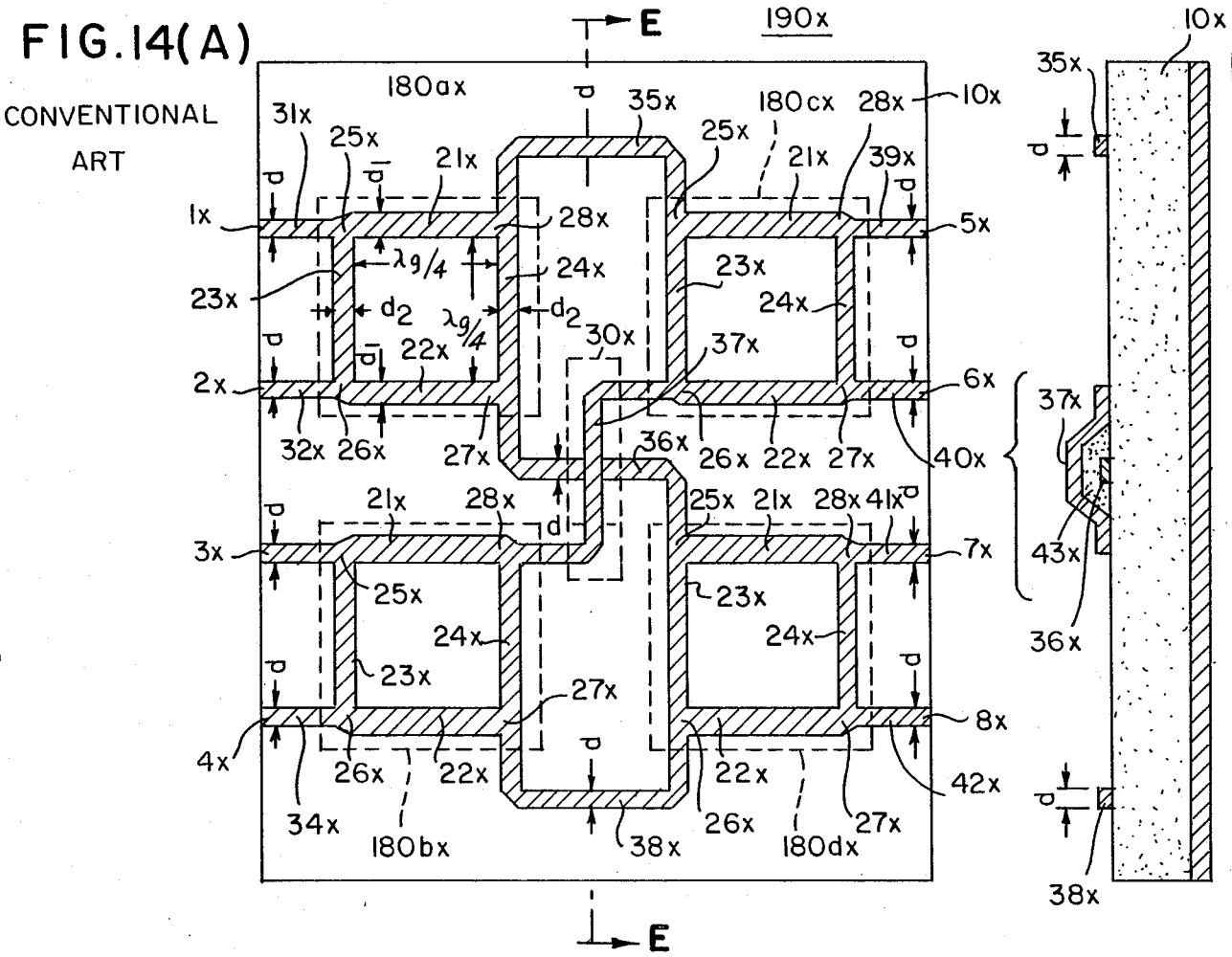
FIG. 14(A) CONVENTIONAL ART
FIG. 14(B) CONVENTIONAL ART
FIG. 14(A) is s top plan view showing the four input and four output multi terminal directional coupler using a four branch line directional coupler.
FIG. 14(B) is a vertical cross sectional view taken along the line E—E′ of FIG. 14(A)

The multi terminal directional coupler as mentioned above is equivalent to the circuit 100*x* of FIG. 1, and can operate in the same manner as the coupler of FIGS. 14(A) and 14(B). In the embodiment mentioned above the terminals 1*x* to 4*x* are used as the signal input terminal and the terminals 5*x* to 8*x* are used as the output terminals. However, the multi terminal directional coupler according to the present invention is a reversible circuit. Therefore, terminals 1*x* to 4*x* may be used as the signal output terminals and terminals 5*x* to 8*x* may be used as the signal input terminals.

Figure 6:
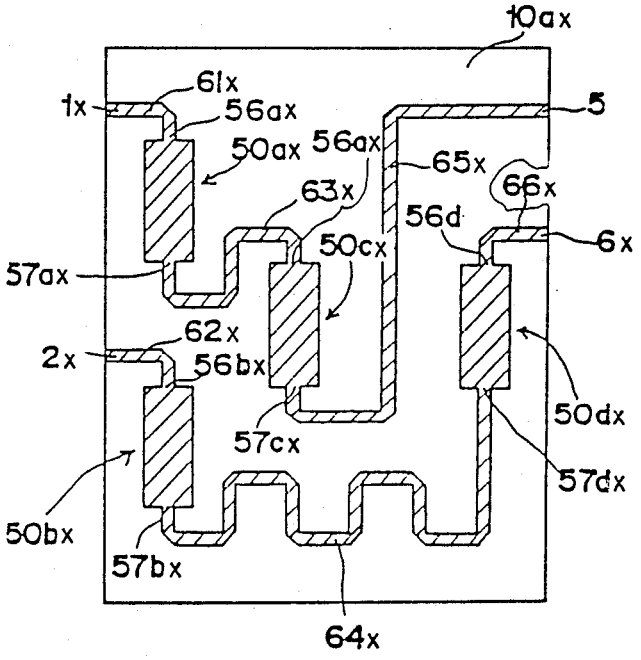
FIG. 6(A) is a top plan view showing the multi terminal directional coupler of FIG. 5(A)
FIG. 6(B) is a top plan view of a ground conductor used in the multi terminal directional coupler of FIG. 5(A)
FIG. 6(C) is a top plan view showing conductor patterns of the bottom surface of the multi terminal directional coupler of FIG. 5(A)
Figure 6B:
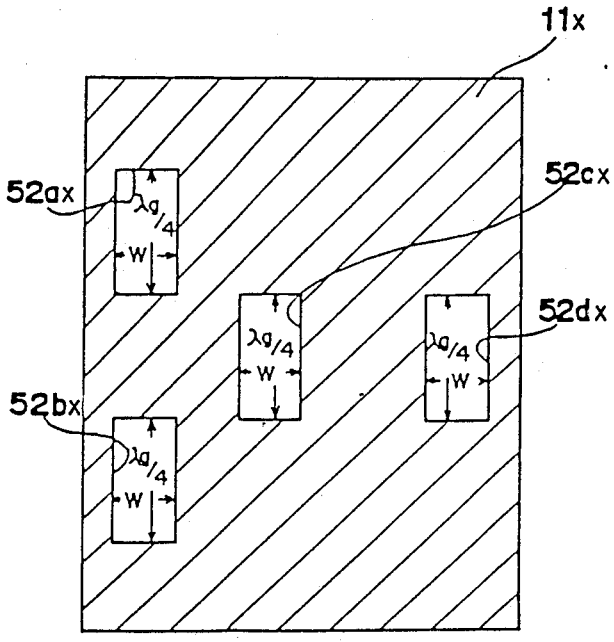
Figure 6:
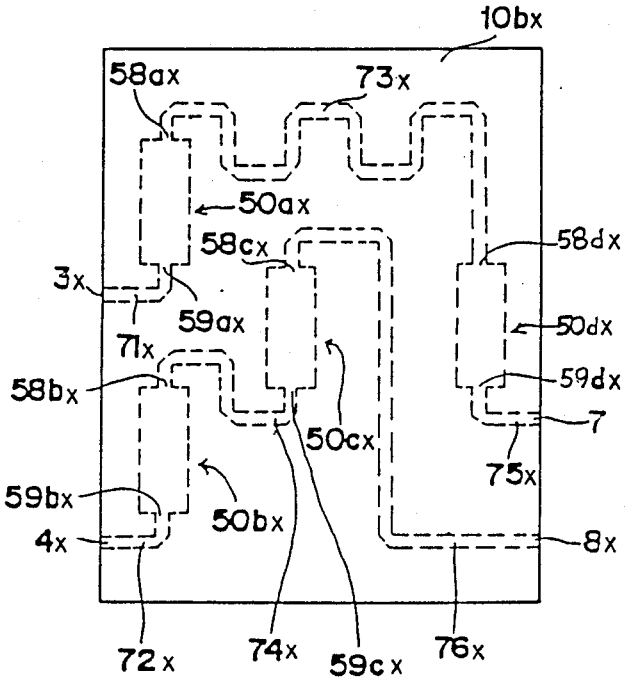

In the arrangement of this embodiment, four directional couplers 50*ax* to 50*dx* are used with the two directional couplers 50*ax* and 50*bx* juxtaposed on the upper portion and the lower portion of FIGS. 6(A) to 6(C) and two directional couplers 50*cx* and 50*dx* juxtaposed on the left portion and the right portion of FIGS. 6(A) and 6(C). Therefore, the size of the multi terminal directional coupler 60*x* can be decreased about $\frac{2}{3}$ compared to a conventional coupler as shown in FIGS. 14(A) and 14(B). Since the solid crossing 30*x* formed by the strip conductor 37*x* as shown in FIGS. 14(A) and 14(B) can be eliminated, the input signal can be divided into equivalent power having a good uniformity. In this embodiment, since the solid crossing 30*x* is eliminated, the circuit patterns can be made accurately and the electric lengths between the input and output terminal can be made uniform. Therefore there can be obtained an accurate phase relation at the input terminal and the output terminal. The conductor patterns on the dielectric substrate of FIG. 5(A) is equivalent to the patterns that are reversed by 180° from the conductor pattern on the dielectric substrate 10*b* and the two conductor patterns can be formed by the same pattern.

Figure 8:
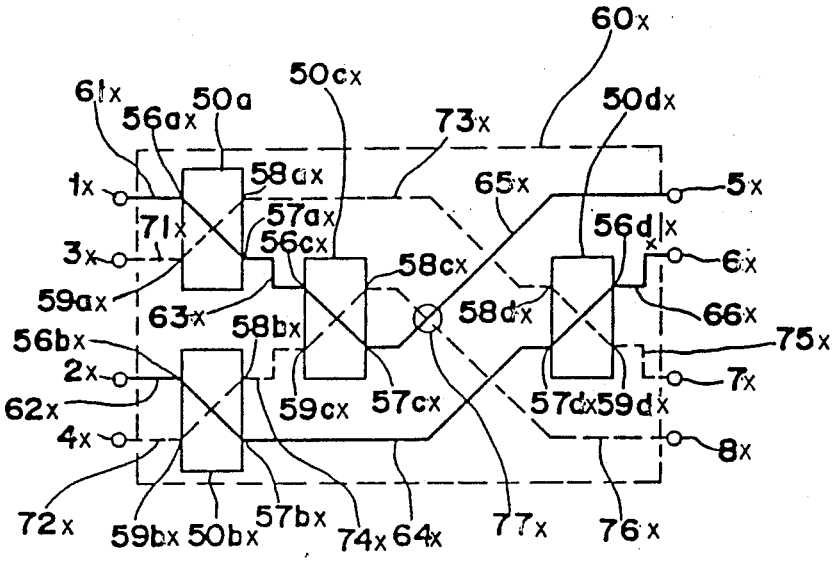
FIG. 8(A) is a circuit diagram of the multi terminal directional coupler of FIGS. 5(A) to 5(D)
FIG. 8(B) is a circuit diagram showing a modification of the multi terminal directional coupler of FIGS. 5(A) to 5(D)
Figure 8:
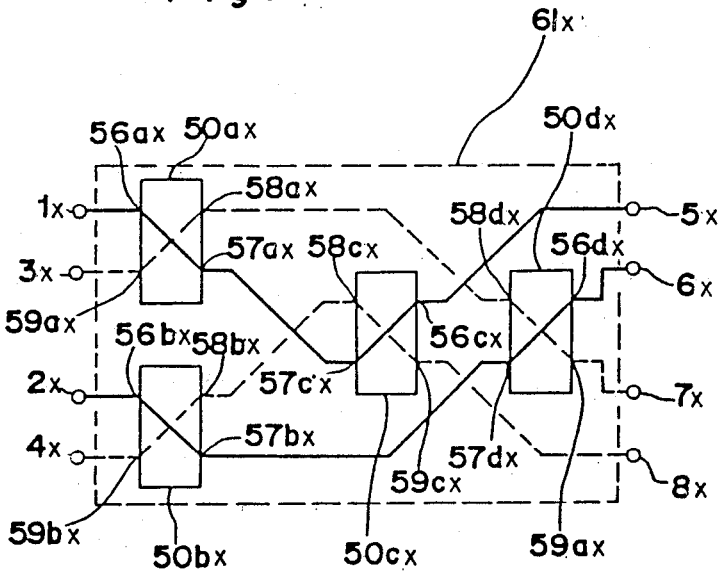

FIG. 8(A) is a circuit diagram of a multi terminal directional coupler 60*x* wherein the connection strip conductors formed on the top surface and the lower surface of the multi terminal directional coupler 60*x* of FIGS. 5(A) to 5(B) are separately shown. In FIG. 8(A), the real lines in the connection line and the directional coupler show the connection conductors 51*aax*, 51*bax*, 51*cax* and 51*dax* formed on the dielectric substrate 10*ax* and the connection strip conductors 61*x* to 66*x*. The dotted lines in the connection lines and the directional coupler show the connection conductors 51*abx*, 51*bbx*, 51*cbx* and 51*dbx* and the connection strip conductors 71*x* to 76*x*. As shown in FIG. 8(A), the directional coupler 50*cx* may be located as shown in FIG. 8(B) at the solid crossing position 77*x* on which the connection strip conductors 65*x* and 76*x* cross in a solid manner. The multi terminal directional coupler 61*x* arranged as mentioned above can act in the same manner as the multi terminal directional coupler 60*x* with the same advantage as the multi terminal directional coupler 60*x*.

Figure 9:
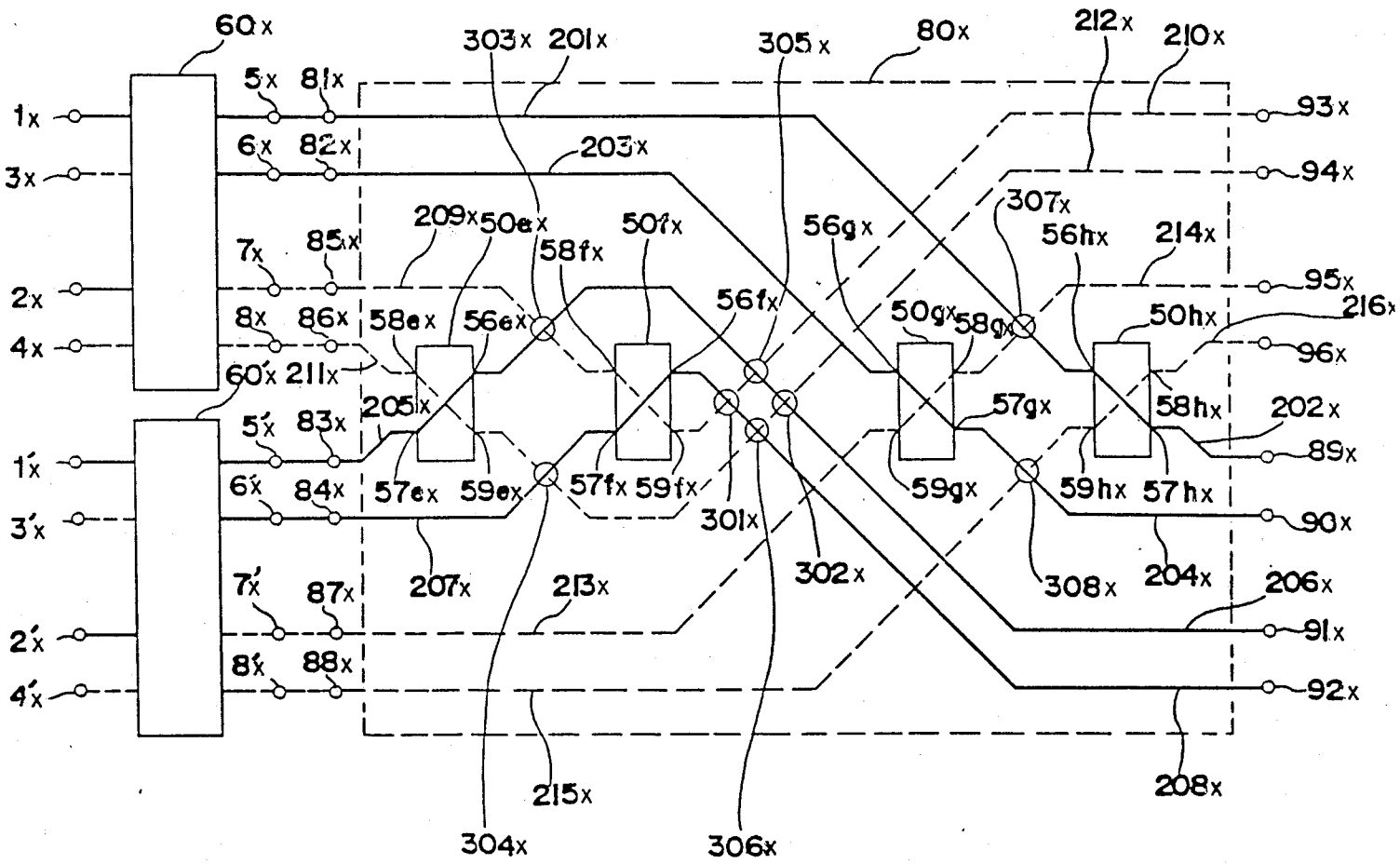
FIG. 9 is a circuit diagram showing the multi terminal directional coupler of FIG. 7(A) to 7(C)

FIG. 9 is a further example of the multi terminal directional coupler having 8 input terminals and 8 output terminals according to the present invention. The multi terminal directional coupler includes two multi terminal directional couplers 60*x* and 60'*x* having four input and four output terminals and a directional coupler 80*x* having 8 input terminals and 8 output terminals. The multi terminal directional coupler 60'*x* is formed in the same manner as the multi terminal directional coupler 60*x* shown in FIGS. 5(A) to 5(D) and includes four signal input terminals 1'*x* to 4'*x* and four signal output terminals 5'*x* to 8'*x*. The directional coupler 80*x* includes four directional couplers 50*ex* to 50*hx* having the same structure as the directional couplers 50*ax* to 50*dx*, and act similar to the conventional directional coupler 118*x* of FIG. 8. The signal output terminals 5*x* to 8*x* and 5'*x* to 8'*x* are connected to the signal input terminals 81*x* to 88*x* and the multi terminal directional coupler of FIG. 9 acts similar to the conventional multi terminal directional coupler 120*x* of FIG. 12.

Figure 7:
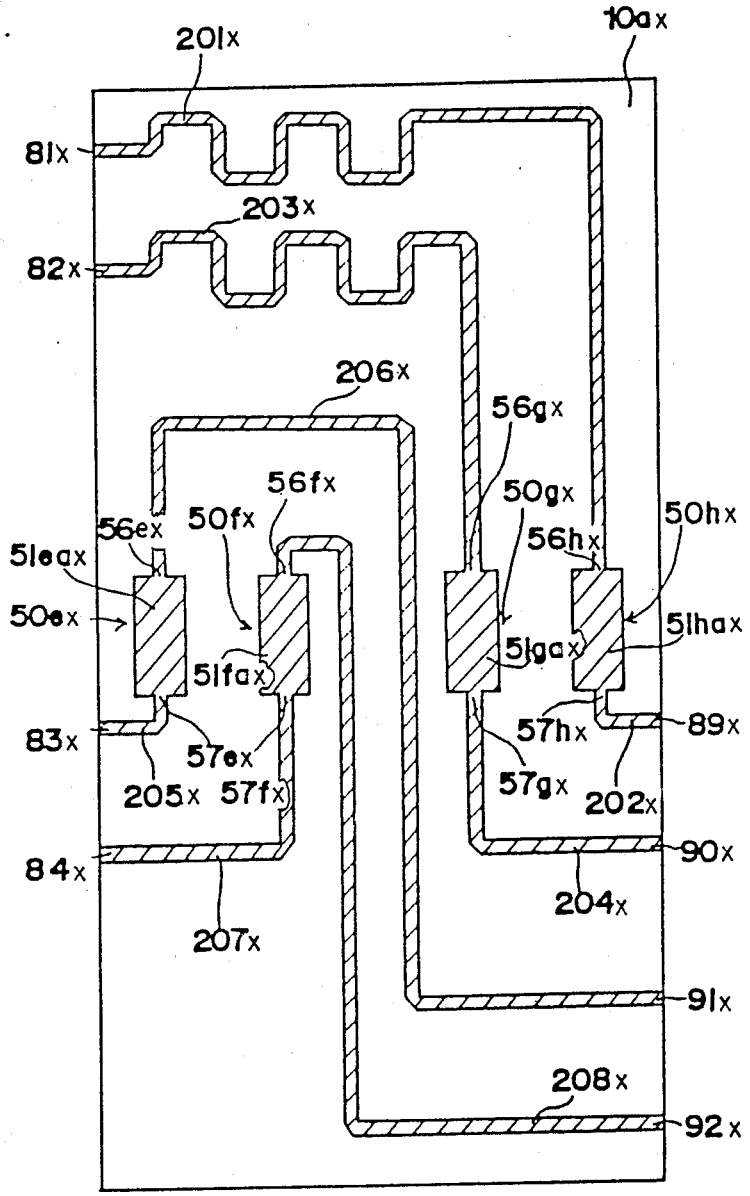
FIG. 7(A) is a top plan view showing another example of the directional coupler forming the rear part of an eight input and an eight output multi terminal directional coupler.
FIG. 7(B) is a top plan view showing a ground conductor of the directional coupler of FIG. 7(A)
FIG. 7(C) is a top plan view of the conductor patterns of the directional coupler of FIG. 7(A)
Figure 7:
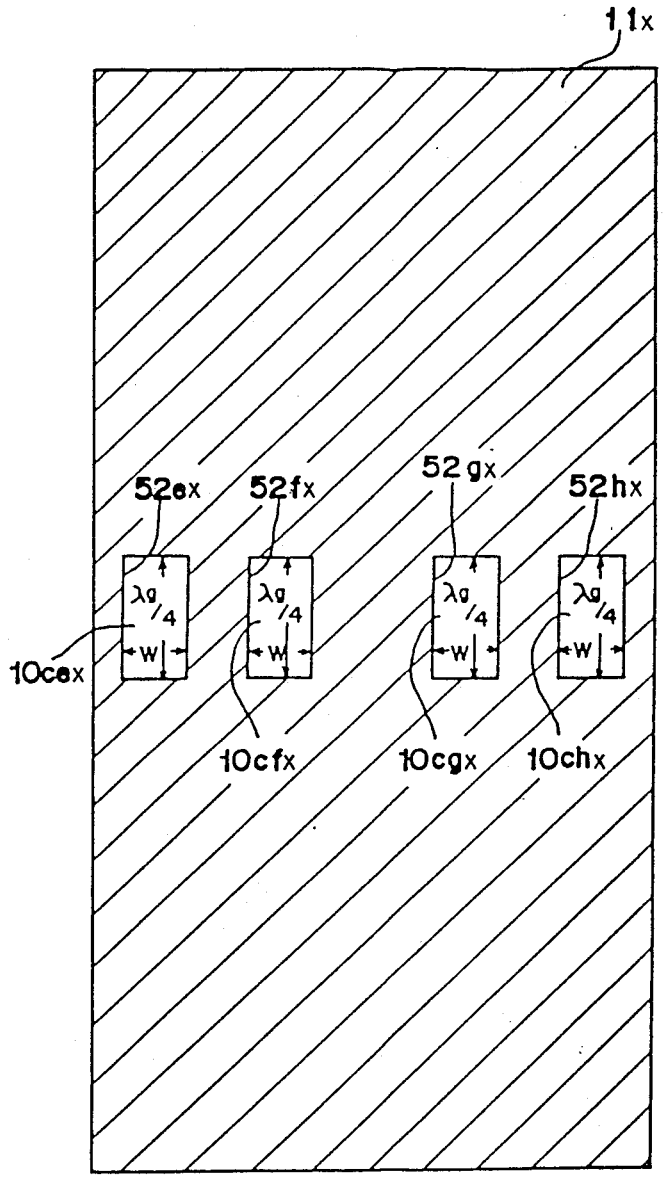
Figure 7C:
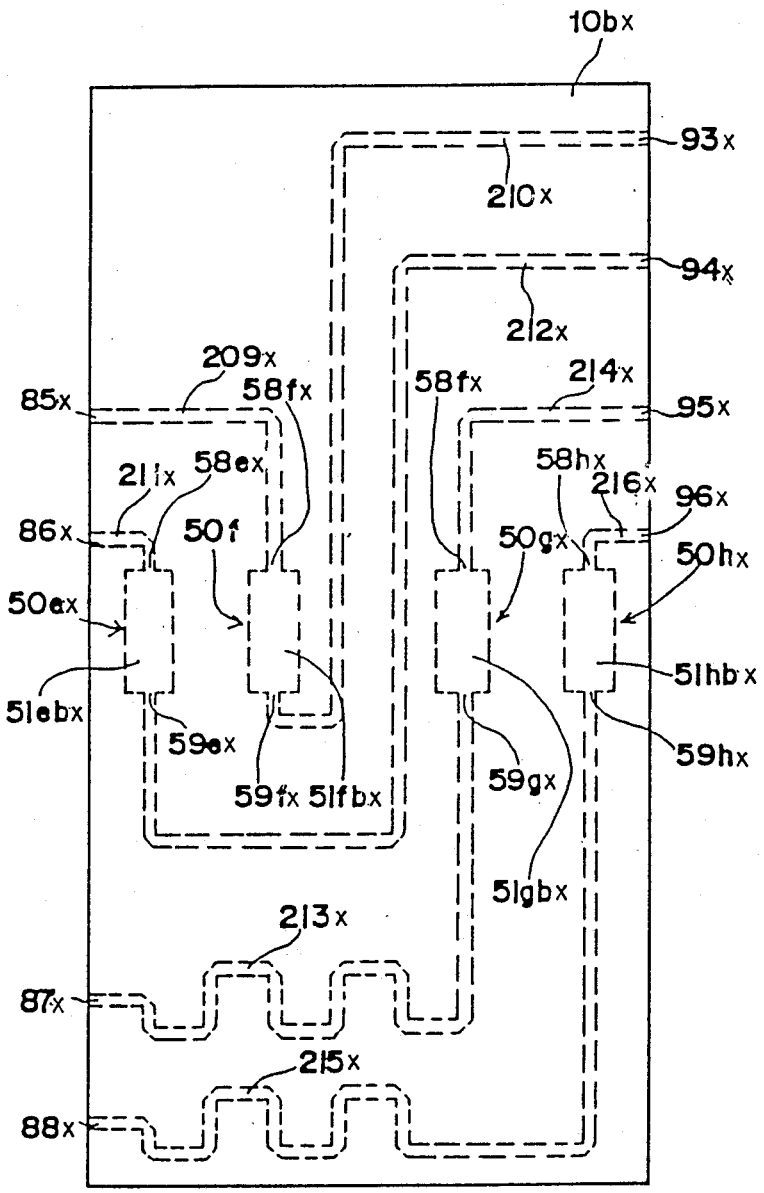

FIGS. 7(A) to 7(C) show the specific structure of the directional coupler 80*x* of FIG. 9. In FIGS. 7(A) to 7(C), although there is shown only one directional coupler 80*x*, the directional coupler 80*x* is formed integrally with the two multi terminal directional couplers 60*x* and 60'*x* on the dielectric substrate 10*ax* and 10*bx*. The structure of the directional coupler 80*x* is explained hereinafter.

In FIGS. 7(A) to 7(C), four coupling conductors 51*eax*, 51*fax*, 51*gax* and 51*hax* having the same shape as the conductor 51*aax* are juxtaposed in left and right directions with the predetermined space in the central portion of the upper surface of the dielectric substrate 10*ax* directly above the coupling dielectric materials 10*cex*, 10*cfx*, 10*cgx* and 10*chx*.

In FIGS. 7(A) to 7(C), four coupling conductors 51*ebx*, 51*fbx*, 51*gbx* and 51*hbx* having the same shape as the conductor 51*abx* are juxtaposed in left and right directions with the predetermined space on the central portion of the upper surface of the dielectric substrate 10*bx* directly below the coupling dielectric materials 10*cex*, 10*cfx*, 10*cgx* and 10*chx*. Accordingly, there is formed a directional coupler 50*ex* having a 3 dB coupling degree being the same as the directional coupler 50*ax* by the coupling conductors 51*eax* and 51*ebx* and the ground conductor 11*x*. There is formed a directional coupler 50*fx* having a 3 dB coupling degree the same as the directional coupler 50*ax* by the coupling conductors 51*fax* and 51*fbx* and the ground conductor 11*x*. There is formed a directional coupler 50*gx* having a 3 dB coupling degree the same as the directional coupler 50*ax* by the conductors 51*gax* and 51*gbx* and the ground conductor 11*x*. There is formed a directional coupler 50*hx* having a 3 dB coupling degree the same as the directional coupler 50*ax* by the coupling conductors 51*hax* and 51*hbx* and the ground conductor 11*x*.

On the top surface of the dielectric substrate 10*ax*, as shown in FIG. 7(A), the signal input terminal 81*x* is connected to the connection terminal 56*hx* in the upper portion of the coupling conductor 51*hax* of the directional coupler 50*hx* through a connection strip conductor 201*x* having a zigzag shape. The connection terminal 57*hx* on the lower portion of the coupling conductor 51*hax* of the directional coupler 50*hx* is connected to the signal output terminal 89*x* through the connection strip conductor 202*x*. The signal input terminal 82*x* is connected to the connection terminal 56*gx* in the upper portion of the coupling conductor 51*gax* of the directional coupler 50*gx* through a connection strip conductor 203*x* having a zigzag shape. The connection terminal 57*gx* on the lower portion of the coupling conductor 51*gax* of the directional coupler 50*gx* is connected to the signal output terminal 90*x* through the connection strip conductor 204*x*. The signal input terminal 83*x* is connected to the connection terminal 57*ex* in the lower portion of the coupling conductor 51*eax* of the directional coupler 50*ex* through a connection strip conductor 205*x* having a zigzag shape. The connection terminal 56*ex* in the upper portion of the coupling conductor 51*eax* of the directional coupler 50*ex* is connected to the signal output terminal 91*x* through the connection strip conductor 206*x*. The signal input terminal 84*x* is connected to the connection terminal 57*fx* in the lower portion of the coupling conductor 51*fax* of the directional coupler 50*fx* through a connection strip conductor 207*x*. The connection terminal 56*fx* on the upper portion of the coupling conductor 51*fax* of the directional coupler 50*fx* is connected to the signal output terminal 92*x* through the connection strip conductor 208*x*.

As shown in FIG. 7(C), on the lower surface of the dielectric substrate 10*bx*, the signal input terminal 85*x* is connected to the connection terminal 58*fx* in the upper portion of the coupling conductor 51*fbx* of the directional coupler 50*x* through a connection strip conductor 209*x*. The connection terminal 59*fx* in the lower portion of the coupling conductor 51*fbx* of the directional coupler 50*fx* is connected to the signal output terminal 93*x* through the connection strip conductor 210*x*. The signal input terminal 86*x* is connected to the connection terminal 58*ex* in the upper portion of the coupling conductor 51*ebx* of the directional coupler 50*ex* through a connection strip conductor 211*x*. The connection terminal 59*ex* on the lower portion of the coupling conductor 51*ebx* of the directional coupler 50*ex* is connected to the signal output terminal 94*x* through the connection strip conductor 212*x*. The signal input terminal 87*x* is connected to the connection terminal 59*gx* in the lower portion of the coupling conductor 51*gbx* of the directional coupler 50*gx* through a connection strip conductor 213*x* having a zigzag shape. The connection terminal 58*gx* on the upper portion of the coupling conductor 51*gbx* of the directional coupler 50*gx* is connected to the signal output terminal 95*x* through the connection strip conductor 214*x*. The signal input terminal 88*x* is connected to the connection terminal 59*hx* in the lower portion of the coupling conductor 51*hbx* of the directional coupler 50*hx* through a connection strip conductor 25*x* having a zigzag shape. The connection terminal 58*hx* in the upper portion of the coupling conductor 51*hbx* of the directional coupler 50*hx* is connected to the signal output terminal 96*x* through the connection strip conductor 216*x*.

The width of the respective connection strip conductors 201*x* to 216*x* is determined corresponding to the characteristic impedance.

It is noted that the respective signal input terminals 81*x* to 84*x* and the signal output terminals 89*x* to 96*x* are formed alternatively on the dielectric substrates 10*ax* and 10*bx* as shown in FIGS. 7(A) and 7(C) with the different positions on one side of the dielectric substrates 10*ax* and 10*bx*. Accordingly, when connecting the lead wires to the signal input and output terminals 81*x* and 96*x*, the connection points do not overlap and the connection of the lead wires is easy.

In order to output the signal corresponding to the input signal applied to the signal input terminals 81*x* to 88*x* at the respective output terminals 89*x* to 96*x* with the same phase difference, the electric length of the connection strip conductor begins from the respective signal input terminals 81*x* to 88*x* and ends at the signal output terminals 89*x* to 96*x* through the respective directional couplers. That is, the total electric length of the connection strip conductors 201*x* and 202*x* includes the total electric length of the connection strip conductors 203*x* and 204*x*; the total electric length of the connection strip conductors 205*x* and 206*x* and the total electric length of the connection strip conductors 207*x* and 208*x* being uniform. The total electric length of the connection strip conductors 209*x* and 210*x* includes the total electric length of the connection strip conductors 211*x* and 212*x*, the total electric length of the connection strip conductors 213*x* and 214*x* and the total electric length of the connection strip conductors 215*x* and 216*x* being uniform.

Figure 12:
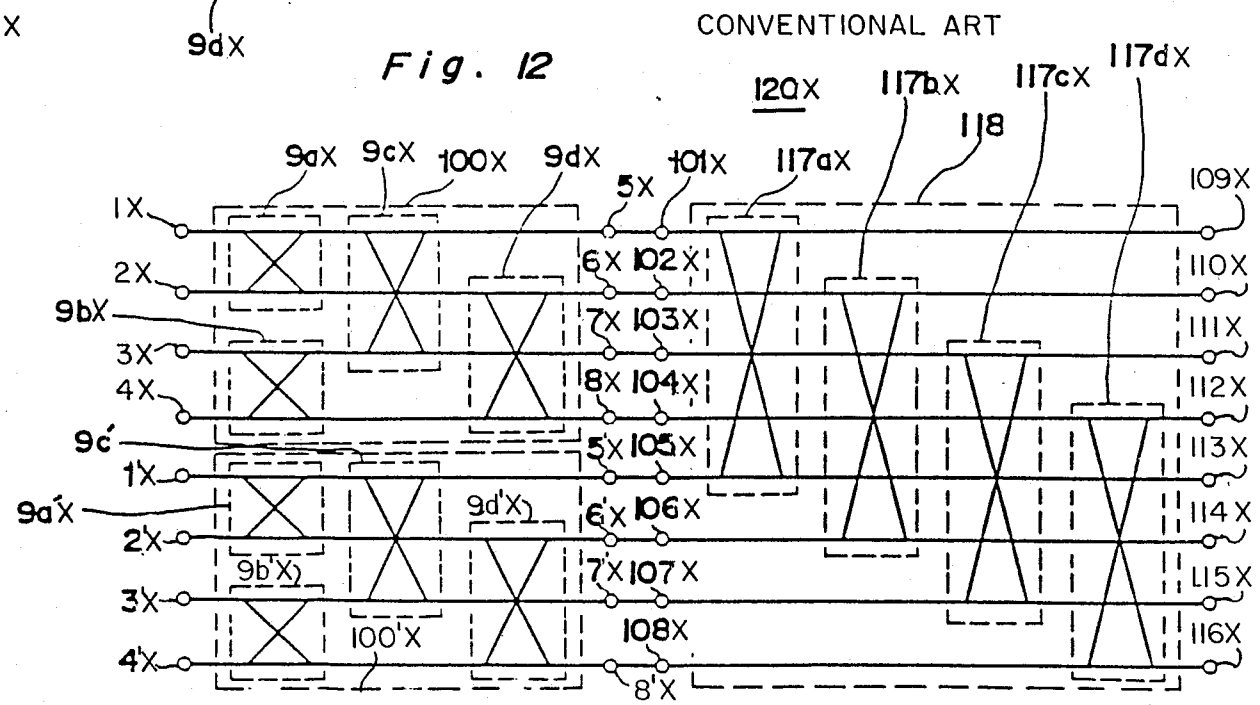
FIG. 12 is a circuit diagram showing the conventional eight input and eight output multi terminal directional coupler.
Figure 13:
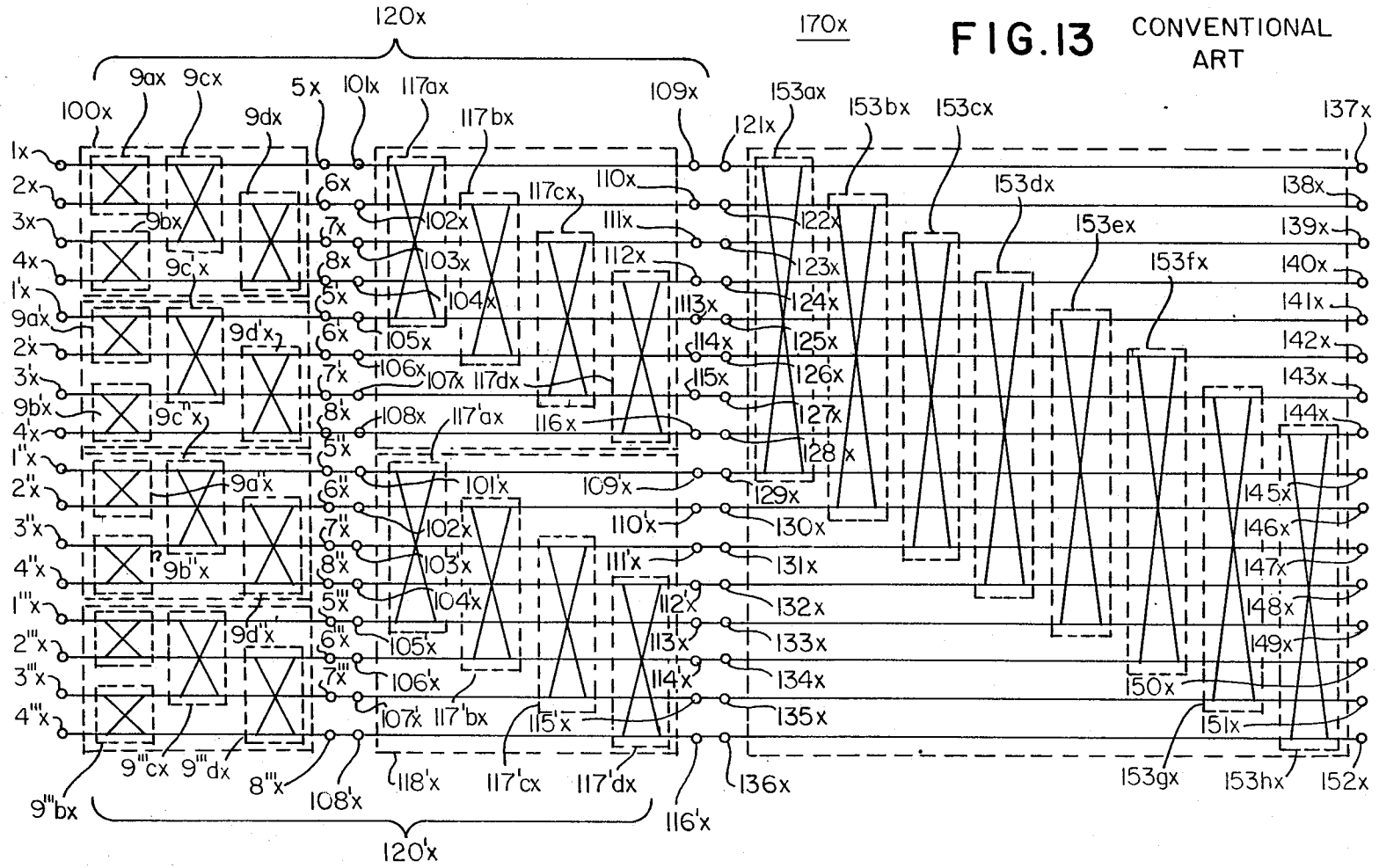
FIG. 13 CONVENTIONAL ART
FIG. 13 is a circuit diagram showing the conventional sixteen input and sixteen output multi terminal directional coupler.

The directional coupler 80*x* mentioned above is connected to the multi terminal directional couplers 60*x* and 60'*x* formed integrally. It is possible to provide the 8 input and 8 output multi terminal directional coupler 118*x* as shown in FIG. 12 and the directional coupler 80*x* operates similar to the known multi terminal directional coupler 120*x* of FIG. 12. The multi terminal directional coupler 120*x* is a reversible circuit similar to the multiple directional coupler 60*x*. The multi terminal directional coupler arranged using the directional couplers 50*ax* to 50*hx* has the same advantage as the multi terminal directional coupler 60*x* of FIGS. 5(A) to 5(B). Although, in the embodiments of FIGS. 7 and 9, the respective directional couplers 50*ex* and 50*fx* are located at positions as shown in FIG. 9, the directional coupler 50*ex* may be located at the solid crossing portion between the input terminals 83*x* and 86*x* and the output terminals 91*x* and 94*x*. That is, the directional coupler 50*ex* may be located at the position of the directional coupler 50*ex* as presently shown in FIG. 9 or at a position 302*x* where the connection strip conductors 206*x* and 212*x* cross in a solid manner. Also, the directional coupler 50*fx* may be located at the solid crossing portion between the input terminals 84*x* and 85*x* and the output terminals 92*x* and 93*x*. That is, at a position where the connection strip conductors 208*x* and 210*x* cross a solid manner. In addition, the directional couplers 50*ex* and 50*fx* may be located at any one of four positions mentioned below.

(1) The directional coupler 50*ex* is located at a position 303*x* where the connection strip conductors 206*x* and 209*x* cross in a solid manner. The directional coupler 50*fx* is located at a position 304*x* where the connection strip conductors 207*x* and 212*x* cross in a solid manner.

(2) The directional coupler 50*ex* is located at a position 305*x* where the connection strip conductors 206*x* and 210*x* cross in a solid manner. The directional coupler 50*fx* is located at a position 306*x* where the connection strip conductors 208*x* and 212*x* cross in a solid manner.

(3) The directional coupler 50*ex* is located at a position 303*x* and the directional coupler 50*fx* is located at a position 306*x*.

(4) The directional coupler 50*ex* is located at a position 304*x* and the directional coupler 50*fx* is located at a position 305*x*.

Although, in the embodiments of FIGS. 7 and 9, the respective directional couplers 50*gx* and 50*hx* are located at positions as shown in FIG. 9, the directional coupler 50*gx* may be located at the solid crossing portion 307*x* where the connection strip conductors 201*x* and 214*x* cross in a solid manner. The directional coupler 50*hx* may be located at the solid crossing position 308*x* where the connection strip conductors 204*x* and 215*x* cross in a solid manner.

Although the embodiment is explained with respect to the directional coupler having four or eight input and output terminals, the present invention is not limited to this embodiment. For example, the present invention may be applied to a multi terminal directional coupler having more than 16 terminals. In general, the present invention may be applied to a multi terminal directional coupler comprising:

first input terminals with the number of terminals being N/2 wherein N is $2^n$ (n is natural number) and N/2 first output terminals being respectively juxtaposed on one side of the ground conductor through the first dielectric substrate;

N/2 second input terminals and N/2 second output terminals being juxtaposed on another side of the ground conductor through the second dielectric substrate;

the first multi terminal directional coupler comprising $n \times 2^{n-1}$ directional couplers formed on the first dielectric substrate and connected to the N/4 first input terminals and the N/4 second input terminals, the N/4 third output terminals formed on the first dielectric substrate and the N/4 fourth output terminals formed on the second dielectric substrate;

the second multi terminal directional coupler including $n \times 2^{n-1}$ directional couplers formed on the first dielectric substrate and connected to the N/4 first input terminals and the N/4 second input terminals, the N/4 fifth output terminals formed on the second dielectric substrate and the N/4 sixth output terminals formed on the second dielectric substrate;

N/4 first directional couplers connected to either one of the N/4 third output terminals of the first multi terminal directional coupler and one of the N/4 sixth output terminals of the second multi terminal directional couplers without overlapping each other and connected to either one of the N/4 first output terminals and one of the N/4 second output terminals without overlapping each other; and N/4 second directional couplers connected to either one of the N/4 fourth output terminals of the first multi terminal directional coupler and one of the N/4 fifth output terminals of the second multi terminal directional couplers without overlapping each other and connected to either one of the N/4 first output terminals and one of the N/4 second output terminals without overlapping each other;

whereby the first multi terminal directional coupler, the second multi terminal directional coupler, the N/4 first directional couplers and the N/4 second directional couplers and two coupling conductors in which the respective opposite ends form the input terminals and the output terminals are formed on both sides of the ground conductor through the first dielectric substrate and the second substrate, so that the respective coupling conductors are coupled electromagnetically through the opening defined in the ground conductor.

In the present embodiment, the respective coupling conductors 51*aax*, 51*abx*, 51*bax*, 51*bbx*, 51*cax*, 51*cbx*, 51*dax*, 51*dbx*, 51*eax*, 51*ebx*, 51*fax*, 51*fbx*, 51*gax*, 51*gbx*, 51*hax* and 51*hbx* and the coupling openings 52*ax* to 52*hx* are elongated in rectangular shape. The shape of the conductors may be selected as desired so far as there are formed openings in the ground conductor 11*x* between the respective pairs of conductors 51*aax* and 51*abx*; 51*bax* and 51*bbx*; 51*cax* and 51*cbx*; 51*dax* and 51*dbx*; 51*eax*, 51*ebx*; 51*fax* and 51*fbx*; 51*gax* and 51*gbx* and 51*hax*, 51*hbx* so that electromagnetic mode coupling is formed between the pairs of the coupling conductors.

As mentioned above, in the present invention, there are provided N input and output terminals (wherein N is $2^l$ (l is a natural number)) and $1\times2^{l-1}$ directional couplers so that signals having a/N power of the input signals applied to the N input terminals can be output at the N output terminals. The respective $1\times2^{l-1}$ directional couplers are formed on both sides of the ground conductor through the first and second dielectric substrates with the two coupling conductors having their opposite ends forming input and output terminals so that the respective coupling conductors can be electromagnetically coupled through the opening defined on the ground conductor formed therebetween. Therefore, the input terminals, the output terminals, the coupling conductors of the respective directional couplers and the strip conductors for connecting the respective terminals and coupling conductors may be formed by dividing the two dielectric substrates into two parts formed on both sides of the ground conductor. Accordingly, the size of the multi terminal directional coupler becomes $\frac{2}{3}$ as compared to a conventional directional coupler so that it is possible to decrease the size and weight. By the arrangement mentioned above, the multi terminal directional coupler can be formed without a solid crossing. Therefore, it is possible to form the circuit patterns accurately and to prevent the interference among the signals propagating in the strip conductors. Therefore, it is possible to provide a multi terminal directional coupler in which the power of the signals can be divided and good electric property is provided.

Referring to FIGS. 15(A) to 15(E) which shows a further embodiment of the present invention, there are defined coupling openings 22*ay* and 22*by* which penetrate a ground conductor 12*y* and have a length on the short side and a length λg/4 on the long side in the upper right portion and the lower right portion of an elongated ground conductor 12*y* having a thickness t0. The coupling openings 232*ay* and 22*by* are filled with coupling insulation materials 10*cay* and 10*cdy*. The ground conductor 12*y* is provided between dielectric substrates 10*ay* and 10*by* which have a thickness of t.

Figure 15C:
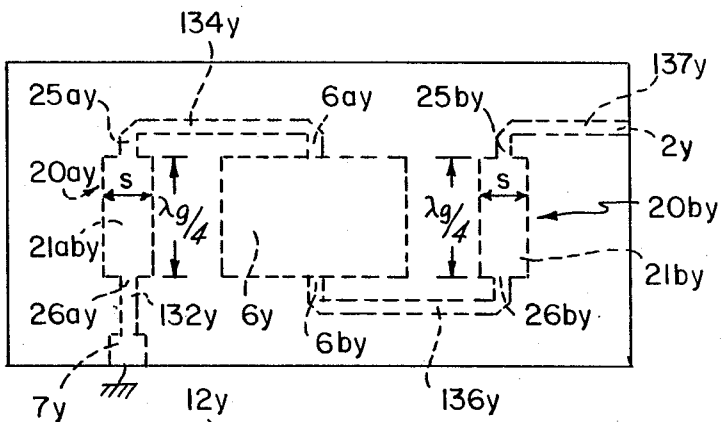
FIG. 15(C) is a top plan view showing the conductor patterns used in the microwave balanced amplifier of FIG. 15(A)
Figure 15E:
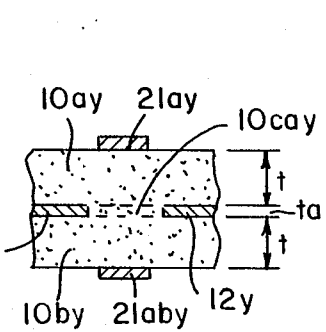
FIG. 15(E) is a vertical cross sectional view taken along the lines of B—B′ of FIG. 15(A)
Figure 15D:
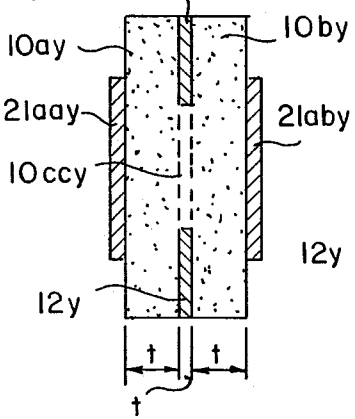
FIG. 15(D) is a vertical cross sectional view taken along the line A—A′ of FIG. 15(A)
Figure 15A:
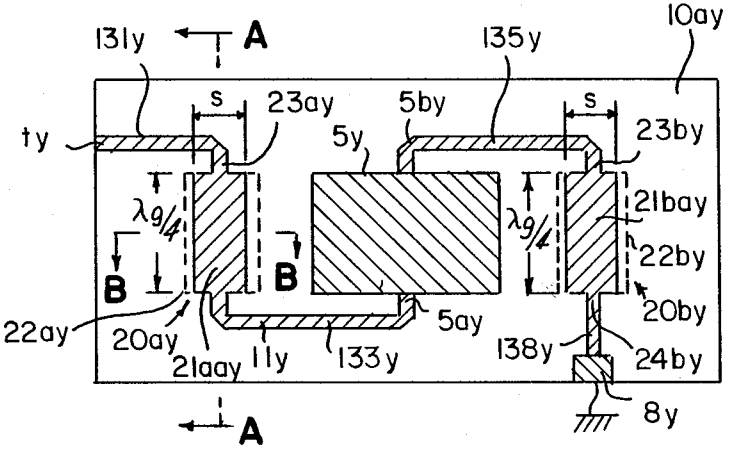
FIG. 15(A) is a top plan view showing a microwave balanced amplifier according to an embodiment of the present invention.
Figure 15B:
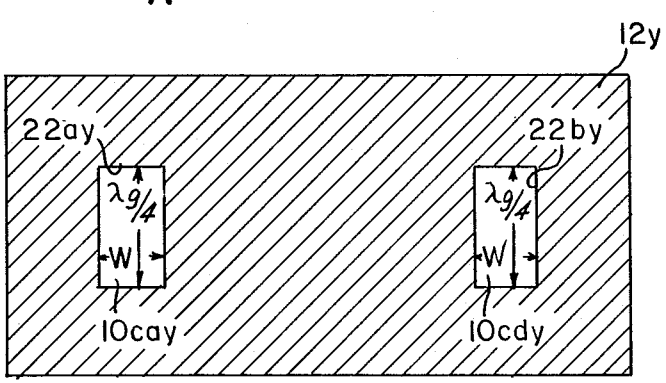
FIG. 15(B) is a top plan view of the ground conductor used in the microwave balanced amplifier of FIG. 15(A)

In the upper left portion of FIG. 15(A) above the dielectric substrate 10*ay*, a coupling conductor 21*aay* of a rectangular shape having a length S on the short side and a length λg/4 on the long side is formed above the coupling insulation material 10*cay*. On the other hand, another coupling conductor 21*aby*, which is similar to the conductor 21*aay*, is formed below the coupling insulation material 10*cay* on the central left portion of FIG. 15(C) on the lower surface of the dielectric substrate 10*by*. The coupling conductors 21*aay* and 21*aby* are so formed that the longitudinal direction of the coupling conductors 21*aay* and 21*aby* is parallel to the respective short sides of the dielectric substrate 10*ay* and 10*by*. When the microwave signals are applied to the ends of the short sides of the coupling conductors 21*aay* and 21*aby*, mode coupling is developed between the coupling conductors 21*aay* and 21*aby* and the ground conductor 12*y* through the coupling insulation material 10*cay* in the coupling opening 22*ay* so that the power of the signal is divided into two parts. The divided signals are input to another terminal and the signals are coupled with the other divided signal and the coupled signals can be output on the respective ends of the short sides of the coupling conductors 21*aay* and 21*aby*. In FIG. 15(A), the dotted lines indicate the position of the coupling openings 22*ay* and 22*by*. In one directional coupler 20*ay*, the respective short sides of the coupling opening 22*ay* of the ground conductor 12*y* and the short sides of the coupling conductors 21*ay* and 21*aby* coincide with each other. The dielectric substrates 10*ay* and 10*by* and the coupling insulation material 10*cay* are made of dielectric material having the same dielectric constant. The directional coupler 20*by* is formed in the same manner as mentioned above.

Figure 16A:
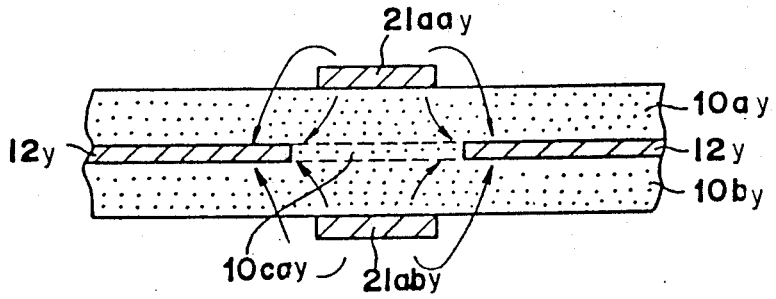
FIGS. 16(A) and 16(B) are vertical cross sectional views showing the electric field distribution for odd and even modes of the vertical drive at the connecting portion of the line B—B′ of FIG. 15(A)
Figure 16B:
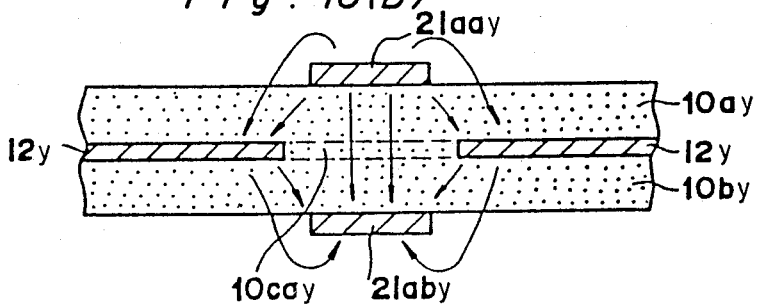

FIGS. 16(A) and 16(B) are respectively vertical cross sectional views showing the electric field distribution of odd and even modes by a known vertical mode driving at the coupling portion on the B—B′ line in FIG. 15. In the even mode of FIG. 16(A), there are developed electric force lines between the connecting conductors 21*aay* and 21*aby* and the ground conductor 12*y*, whereby the opening acts as a magnetic wall. On the other hand, in the odd mode of FIG. 16(B), there are developed electric force lines between the connecting conductors 21*aay* and 21*aby* and the ground conductor 12*y*, whereby the opening acts as an electric wall.

Accordingly, there is formed a directional coupler 20*ay* having a predetermined coupling degree by the ground conductor 12*y* and the connecting conductors 21*aay* and 21*aby* formed on the dielectric substrate 10*ay* and 10*by*. Therefore, there can be provided a four terminal directional coupler 20*ay* having a coupling degree of 3 dB by selecting the dielectric constant of the dielectric substrates 10*ay* and 10*by*, the width of S of the connecting conductors 21*aay* and 21*aby* and the width W of the coupling opening 22*ay*. It is noted that the coupling degree is 3 dB. In order to increase the coupling degree, the width W of the coupling opening 22*ay* is made large.

There is formed a coupling conductor 21*bay* having the same shape of the conductor 21*aay* directly above the coupling insulation material 10*cby* at the central right portion of FIG. 15(A) on the dielectric substrate 10*ay*. A connecting conductor 21*bby* having the same shape of the conductor 21*aby* is formed directly below the coupling insulation material 10*cby* at the central left portion of FIG. 15(B) on the lower surface of the dielectric substrate 10*by*. Accordingly, there can be provided a directional coupler 20*by* having a 3 dB coupling degree in a similar manner as the directional coupler 20*ay* by the ground conductor 12*y* and the connecting conductors 21*bay* and 21*bby*.

A hybrid amplifier 5*y* having a known structure with a predetermined amplification factor is formed at the central portion of the upper surface of the dielectric substrate 10*ay*. A hybrid amplifier 6*y* having a known structure with a predetermined amplification factor is formed at the central portion of the lower surface of the dielectric substrate 10*by*.

In the upper surface of the dielectric substrate 10*ay*, the signal input terminal 1*y* is connected to the connection terminal 23*ay* in the upper portion of the coupling conductor 21*aay* of the directional coupler 20*ay* through a connection strip conductor 131*y*. The connection terminal 24*ay* in the lower portion of the coupling conductor 21*aay* of the directional coupler 20*ay* is connected to the signal input terminal 5*ay* of the amplifier 5*y* through the connection strip conductor 133*y*. The output terminal 5*by* of the amplifier 5*y* is connected to the connection terminal 23*by* in the upper portion of the coupling conductor 21*bay* of the directional coupler 20*by* through a connection strip conductor 135*y*. The connection terminal 24*by* in the lower portion of the coupling conductor 21*bay* of the directional coupler 20*by* is connected to the non reflective terminating device 8*y* through the connection strip conductor 138*y*.

In the lower surface of the dielectric substrate 10*by*, the connection terminal 26*ay* in the lower portion of the connection conductor 21*aby* of the directional coupler 20*ay* is connected to a non reflective terminating device 7*y* through the connection strip conductor 132*y*. The connection terminal 25*ay* in the upper portion of the connection conductor 21*aby* of the directional coupler 20*ay* is connected to the amplifier 6*y* through the connection strip conductors 134*y*. The output terminal 6*by* of the amplifier 6*y* is connected to a connection terminal 26*by* in the lower portion of the connection conductor 21*bby* of the directional coupler 20*by* through the connection strip conductor 136*y*. The connection terminal 25*by* for the connection conductor 21*bby* of the directional coupler 20*by* is connected to the signal output terminal 2*y* through the connection strip conductors 137*y*.

The connection strip conductors 131*y* to 138*y* have respectively desired widths which are defined by the characteristic impedance.

In order to match the impedance of the signal input terminal 1*y* and the signal output terminal 2*y*, two amplifiers 5*y* and 6*y* have the same input and output impedance and the same amplification and gain properties.

The microwave signal entered in the signal input terminal 1*y* is input to the connection terminal 23*ay* of the directional coupler 20*ay*, in which the input signal is divided in two parts. One part of the divided signal is entered to the input terminal 5*ay* of the amplifier 5*y* through the connection terminal 24*ay* situated on the same plane of the connection terminal 23*ay* and further through the strip conductor 133*y*. Another part of the divided signal that is divided by the directional coupler 20*ay* is entered to the input terminal 6*ay* of the amplifier 6*y* through the connection terminal 25*ay* which is located on a plane opposite to the plane having the connection terminal 23*ay* located thereon and further through the connection strip conductor 134*y*. The respective signals output from the output terminal 5*by* of the amplifier 5*y* and the output terminal 6*by* of the amplifier 6*y* are respectively input to the connection terminals 23*by* and 26*by* of the directional coupler 20*by* through the connection strip conductors 135*y* and 136*y*. The respective signals input to the directional coupler 20*by* are composed or coupled and the composed signals are output at the signal output terminal 2*y* through the connection terminal 25*by* and the connection strip conductor 137*y*.

In the microwave balanced amplifier mentioned above, two amplifiers 5*y* and 6*y* are located on the dielectric substrates 10*ay* and 10*by*. Since the two amplifiers are separated by the ground conductor, interference does not occur for the signals from the amplifiers 5*y* and 6*y*. Accordingly, the signal entered into the signal input terminal 1*y* can be processed having good electrical properties. Moreover, because two amplifiers 5*y* and 6*y* and the connection strip conductors are located on both sides of the dielectric substrates 10*ay* and 10*by*, it is possible to decrease the size of the microwave balanced amplifier about ½ of the size of the conventional device. Thereby, the weight of the amplifier device is reduced. Moreover, in the present embodiment it is not necessary to couple the signals by way of ridge coupling using wire or ribbon conductors as employed in the interdigit directional coupler. Whereby, the circuit patterns can be accurately formed and the production of the device in present embodiment is more simple than the production of a conventional device. In addition, since the conductor patterns of the dielectric substrate 10*ay* of FIG. 15(A) is the same as the conductor patterns on the dielectric substrate 10*by* of FIG. 15(C), it is advantageous for the two conductor patterns to be produced using the same pattern.

Figure 17:
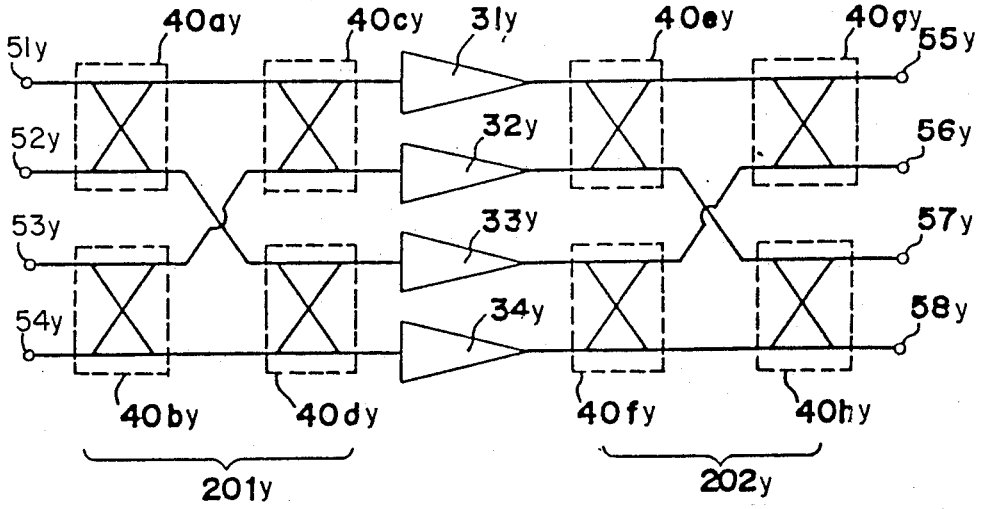
FIG. 17 is an embodiment of a four input and a four output multi terminal amplifier according to the present invention.

FIG. 17 is a circuit diagram showing an embodiment of the four input and four output multi terminal amplifier according to the present invention.

In FIG. 17, four amplifiers 31*y* to 34*y* are connected between the first and second multi terminal directional couplers 201*y* and 202*y*, each coupler has four inputs and four outputs. The multi terminal directional couplers 201*y* and 202*y* include four directional couplers 40*ay* to 40*dy* and 40*ey* to 40*hy* each having a 3 dB coupling degree. Whereby, four output signals each having ¼ power of the input signals applied to the four input terminals can be output at the four output terminals. Accordingly, by changing the amplification factor of the amplifiers 31*y* to 34*y*, there can be obtained at the output terminals 55*y* to 58*y* the output signals each having a desired power level which have been coupled from the input signals entered at the input terminals 51*y* to 54*y* with a predetermined power level and then amplified.

Figure 18A:
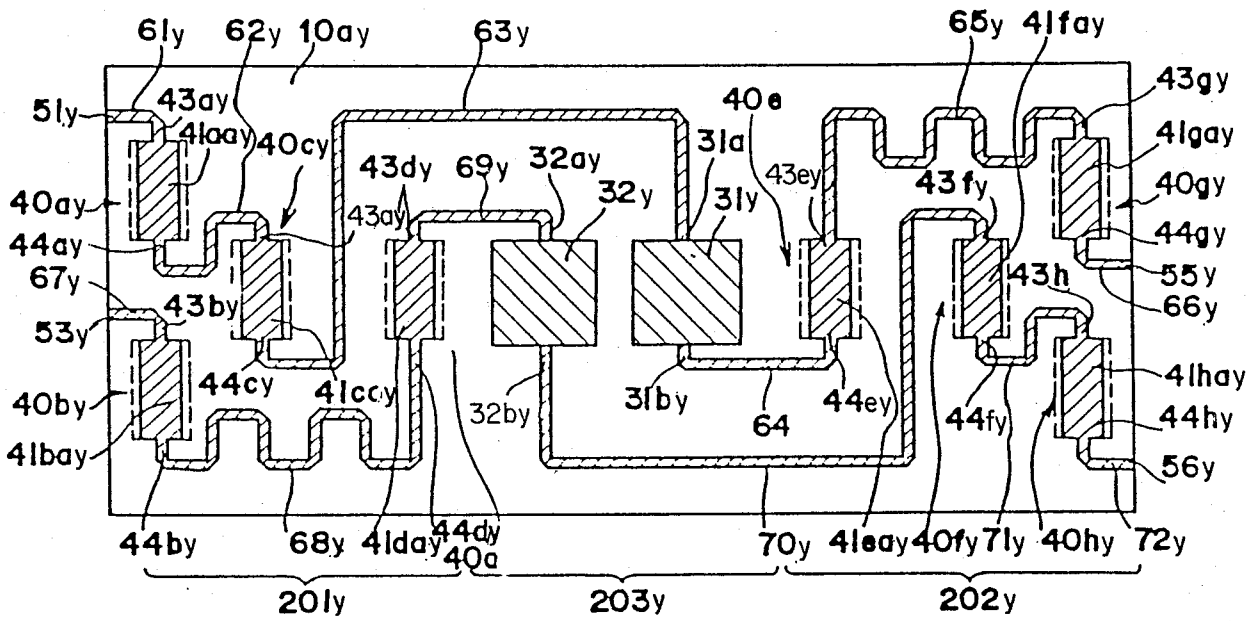
FIG. 18(A) is a top plan view of the multi terminal amplifier for showing the practical feature of the multi terminal directional coupler of FIG. 17.
Figure 18B:
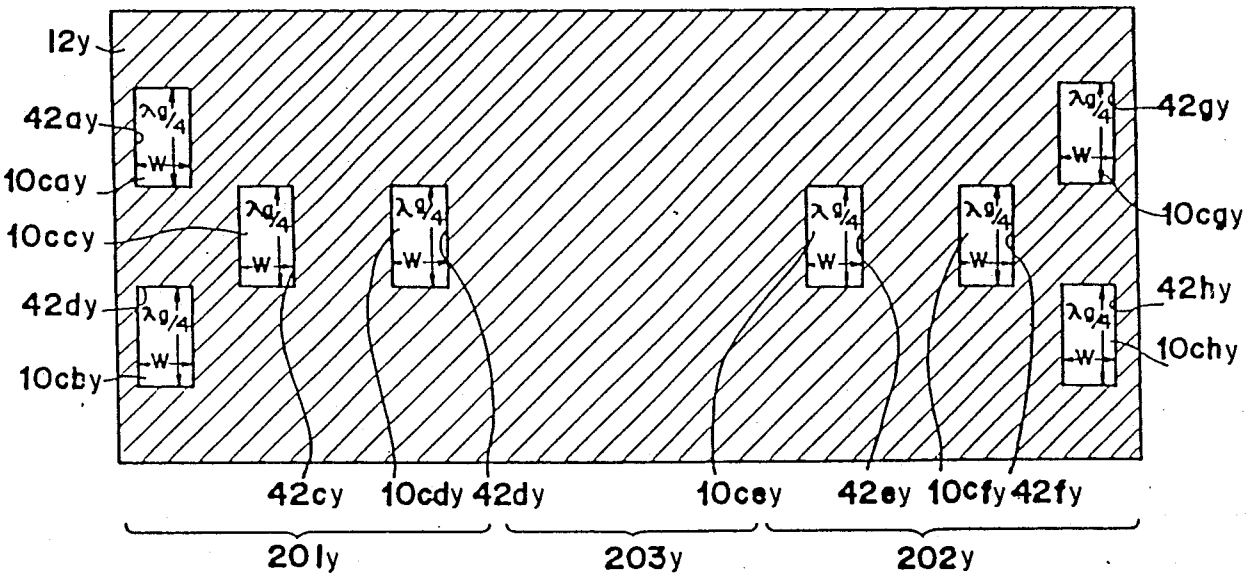
FIG. 18(B) is a top plan view of the ground conductor 12 of the multi terminal amplifier of FIG. 17.
Figure 18:
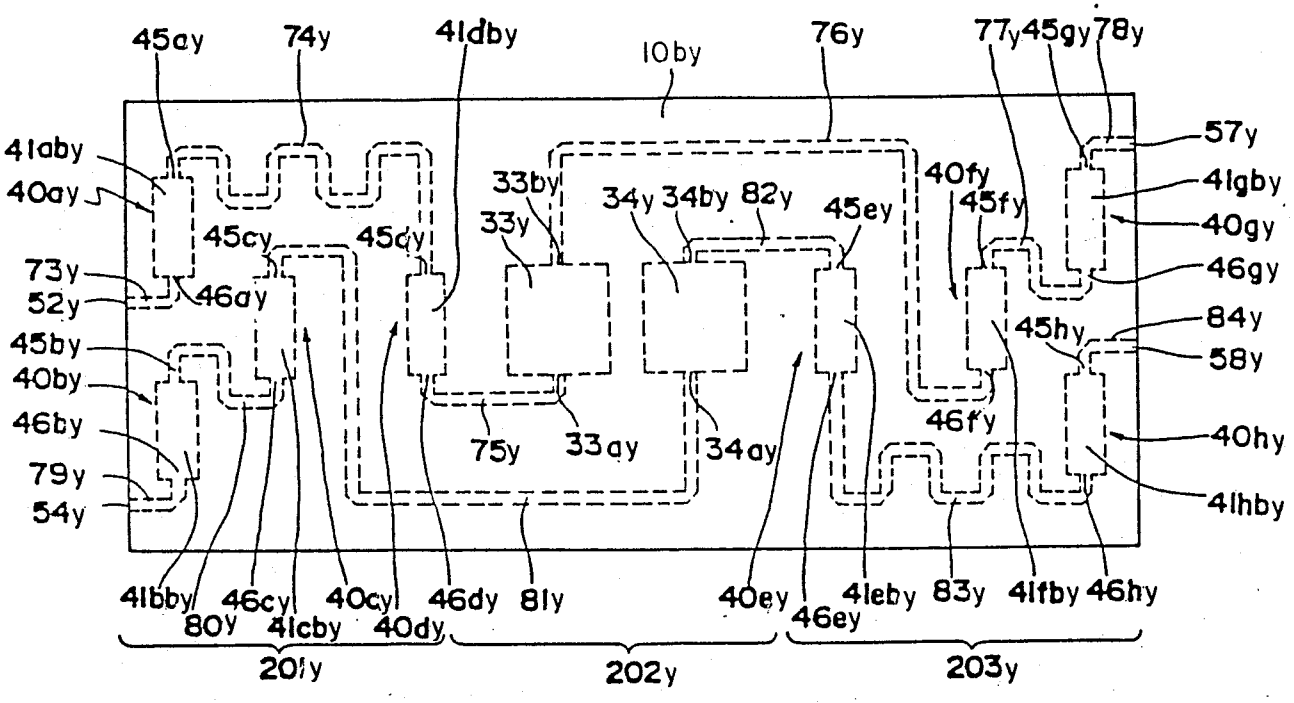
FIG. 18(C) is a top plan view showing the conductor patterns on the dielectric substrate **10*by* used in the multi terminal amplifier of FIG. 17**.

FIGS. 18(A) to 18(C) are circuit diagrams showing a specific structure of the multi terminal amplifier of FIG. 17, FIG. 18(A) is a top plan view of the multi terminal amplifier, FIG. 18(B) is a plan view showing the ground conductor 12*y* of the multi terminal amplifier of FIG. 18(A) and FIG. 18(C) is a plan view showing conductor patterns on the dielectric substrate 10*by* of the multi terminal amplifier of FIG. 18(A). In FIGS. 18(A) to 18(C), like parts are designated with like reference numerals The multi terminal amplifier includes a first directional coupler 201*y* having four directional couplers 40*ay* to 40*dy*, an amplifier formed by four amplifiers 31*y* to 34*y* and a second multi terminal directional coupler 202*y* having four directional couplers 40*ey* to 40*hy*.

In FIG. 18(A), there are defined coupling openings 42*ay* to 42*dy* which penetrate a ground conductor 12*y* and have a length W on the short side and a length λg/4 on the long side in the upper left portion, the lower left portion, the central portion and the central right portion of the multi terminal directional coupler 201*y* of an elongated ground conductor 12*y* having a thickness of t0. The coupling openings 42*ay* to 42*dy* are filled by coupling insulation materials 10*cay* and 10*cby*, 10*ccy* and 10*cdy*. In the left central portion, the right central portion, the upper right portion and the lower right portion of the multi terminal directional coupler 202*y* of the ground conductor 12*y*, there are defined coupling openings 42*ey* to 42*hy* penetrating the ground conductor 12*y* with short sides having a length of W and long sides having a length of λg/4. The respective coupling openings are filled by the coupling insulation materials 10*cey*, 10*cfy*, 10*cgy* and 10*chy*. The ground conductor 12*y* is provided between two dielectric substrates 10*ay* and 10*by*.

On the top surface of the dielectric substrate 10*ay*, there are formed rectangular coupling conductors 41*aay*, 41*bay*, 41*cay*, 41*day*, 41*eay*, 41*fay*, 41*gay* and 41*hay* each having short sides of a length S and long sides of a length λg/4. On the lower surface of the dielectric substrate 10*by* of FIG. 18(C), coupling conductors 41*aby*, 41*bby*, 41*cby*, 41*dby*, 41*eby*, 41*fby*, 41*gby*, and 41*hby* having the same shape as the conductor 41*aay* are respectively formed directly below the coupling insulation materials 10*cay* to 10*chy*. The respective input terminals and output terminals of the multi terminal amplifier are formed on one side of the multi terminal amplifier. In order to form the same electric length between the respective input terminals and output terminals, the coupling conductors 41*aay* to 41*hay* and 41*aby* to 41*hby* are formed in such a manner that the longitudinal direction of the conductors 41*aay* to 41*hay* and 41*aby* to 41*hby* are in a parallel direction to the short side of the dielectric substrates 10*ay* and 10*by*.

Accordingly, similar to the directional couplers 20*ay* and 20*by*, there is formed a directional coupler 40*ay* having a 3 dB coupling degree by the coupling conductors 41*aay* and 41*by* and the ground conductor 12*y*. In a similar manner, there are formed directional couplers 40*by* to 40*hy* having a 3 dB coupling degree.

On the top surface of the dielectric substrate 10*ay*, the signal input terminal 51*y* is connected to the connection terminal 43*ay* in the upper portion of the coupling conductor 41*aay* of the directional coupler 40*ay* through a connection strip conductor 61*y*. The connection terminal 44*ay* in the lower portion of the coupling conductor 41*aay* of the directional coupler 40*ay* is connected to the connection terminal 43*cy* in the upper portion of the coupling conductor 41*cay* of the directional coupler 40*cy* through the connection strip conductor 62*y* which has an S shape. The connection terminal 44*cy* in the lower portion of the coupling conductor 41*cay* of the directional coupler 40*cy* is connected to the input terminal 31*ay* of the amplifier 31*y* through a connection strip conductor 63*y*. The signal input terminal 53*y* is connected to the connection terminal 43*by* in the upper portion of the coupling conductor 41*bay* of the directional coupler 40*by* through the connection strip conductor 67*y*. The connection terminal 44*by* in the lower portion of the coupling conductor 41*bay* of the directional coupler 40*by* is connected to the connection terminal 44*by* in the lower portion of the coupling conductor 41*day* of the directional coupler 40*day* through the connection strip conductor 68*y* which has a zigzag shape. The connection terminal 43*by* in the upper portion of the coupling conductor 41*day* of the directional coupler 40*by* is connected to the input terminal 32*ay* of the amplifier 32*y* through the connection strip conductor 69*y*.

The output terminal 31*by* of the amplifier 31*y* is connected to the connection terminal 44*ey* in the lower portion of the coupling conductor 41*eay* of the directional coupler 40*ey* through the connection strip conductor 64*y*. The connection terminal 43*ey* in the upper portion of the coupling conductor 41*eay* of the directional coupler 40*ey* is connected to the connection terminal 43*gy* in the upper portion of the coupling conductor 41*gay* of the directional coupler 40*gy* through the connection strip conductor 65*y* which has a zigzag shape. The connection terminal 44*gy* in the lower portion of the coupling conductor 41*gay* of the directional coupler 40*gy* is connected to the signal output terminal 55*y* through the connection strip conductor 66*y*. The output terminal 32*by* of the amplifier 32*y* is connected to the connection terminal 43*fy* in the upper portion of the coupling conductor 41*fay* of the directional coupler 40*fy* through the connection strip conductor 70*y*. The connection terminal 44*fy* in the lower portion of the coupling conductor 41*fay* of the directional coupler 40*f* is connected to the connection terminal 43*hy* on the upper portion of the coupling conductor 41*hay* of the directional coupler 40*hy* through the connection strip conductor 71*y* which has an S shape. The connection terminal 44*hy* in the lower portion of the coupling conductor 41*hay* of the directional coupler 40*hy* is connected to the signal output terminal 56*y* through the connection strip conductor 72*y*.

On the lower surface of the dielectric substrate 10*by*, the signal input terminal 52*y* is connected to the connection terminal 46*ay* in the lower portion of the coup ling conductor 41*aby* of the directional coupler 40*ay* through a connection strip conductor 73*y*. The connection terminal 45*ay* on the upper portion of the coupling conductor 41*aby* of the directional coupler 40*ay* is connected to the connection terminal 45*dy* in the upper portion of the coupling conductor 41*dby* of the directional coupler 40*dy* through the connection strip conductor 74*y* which has a zigzag shape. The connection terminal 46*dy* in the lower portion of the coupling conductor 41*dby* of the directional coupler 40*dy* is connected to the input terminal 33*ay* of the amplifier 33*y* through a connection strip conductor 75*y*. The signal input terminal 54*y* is connected to the connection terminal 46*by* in the lower portion of the coupling conductor 41*bby* of the directional coupler 40*by* through the connection strip conductor 79*y*. The connection terminal 45*by* in the upper portion of the coupling conductor 41*bby* of the directional coupler 40*by* is connected to the connection terminal 46*cy* in the lower portion of the coupling conductor 41*cdy* of the directional coupler 40*cy* through the connection strip conductor 80*y* which has an S shape. The connection terminal 45*cy* in the upper portion of the coupling conductor 41*cby* of the directional coupler 40*cy* is connected to the input terminal 34*ay* of the amplifier 34*y* through the connection strip conductor 81*y*.

The output terminal 33*by* of the amplifier 33*y* is connected to the connection terminal 46*fy* in the lower portion of the coupling conductor 41*fby* of the directional coupler 40*fy* through the connection strip conductor 76*y*. The connection terminal 45*fy* in the upper portion of the coupling conductor 41*fby* of the direction coupler 40*fy* is connected to the connection terminal 46*gy* in the lower portion of the coupling conductor 41*gby* of the directional coupler 40*gy* through the connection strip conductor 77*y* which has an S shape. The connection terminal 45*gy* in the upper portion of the coupling conductor 41*gby* of the directional coupler 40*gy* is connected to the signal output terminal 57*y* through the connection strip conductor 78*y*. The output terminal 34*by* of the amplifier 34*y* is connected to the connection terminal 45*ey* in the upper portion of the coupling conductor 41*eby* of the directional coupler 40*ey* through the connection strip conductor 82*y*. The connection terminal 46*ey* in the lower portion of the coupling conductor 41*eby* of the directional coupler 40*ey* is connected to the connection terminal 46*hy* in the lower portion of the coupling conductor 41*hby* of the directional coupler 40*hy* through the connection strip conductor 83*y* which has a zigzag shape. The connection terminal 45*hy* in the upper portion of the coupling conductor 41*hby* of the directional coupler 40*hy* is connected to the signal output terminal 58*y* through the connection strip conductor 84*y*.

The widths of the connection strip conductors 61*y* and 84*y* are determined by the characteristic impedance corresponding thereto.

The signals entered to the signal input terminals 51*y* to 54*y* are processed in the multi terminal amplifiers of FIGS. 18(A) and 18(C). In order to output the processed signals to the signal output terminals 55*y* to 58*y* with the same phase difference against the input signals, the electric length of the connection strip conductor begin from the respective signal input terminals 51*y* to 54*y* and end at the signal output terminals 55*yx* to 58*y* through the respective directional couplers and the amplifiers. That is, the electric length includes the total electric length of the connection strip conductors 61*y* and 66*y*; the total electric length of the connection strip conductors 67*y* to 72*y*; the total electric length of the connection strip conductors 73*y* to 78*y*; and the total electric length of the connection strip conductors 79*y* to 84*y* which are made uniform.

The multi terminal directional coupler arranged as mentioned above is equivalent to the circuit of FIG. 17. By changing the amplification factors of the amplifiers 31*y* to 34*y*, it is possible to obtain the coupled and amplified signals having a desired power level at the signal output terminals 55*y* to 58*y* from the signal input at the signal input terminals 51*y* to 54*y* which are coupled with the same degree.

As mentioned above, since the signal input terminals 51*y* to 54*y*, the signal output terminals 55*y* to 58*y*, the amplifiers 31*y* to 34*y* and the connection strip conductors 61*y* to 84*y* for connecting the respective terminals are divided in two parts on both sides of the dielectric substrates 10*ay* and 10*by* employing the directional couplers 40*ay* to 40*hy* in place of using the interdigit directional coupler, and the size of the four input or output multi terminal amplifier may be decreased to ½ of the conventional multi terminal amplifier using the inter digit directional coupler. In the present embodiment, since it is not necessary to provide a ridge coupling by the wire or ribbon conductor as used in the inter digit directional coupler, the circuit patterns can be accurately made and the manufacturing for the present device is easier than the manufacturing for the conventional device. The conductor patterns on the dielectric substrate 10*ay* of FIG. 18(A) are the same as the patterns which are rotated by 180° from the patterns of the dielectric substrate 10*by* of FIG. 18(C) around the center of the dielectric substrate 10*by*, whereby the respective conduction patterns can be made by the same pattern.

Although in the present embodiment, the hybrid amplifiers 5*y*, 6*y* and 31*y* to 34*y* are formed on the dielectric substrates 10*ay* and 10*by*, the present invention is not limited to this embodiment. It may be possible to replace the dielectric substrates by semiconductor substrates and the hybrid amplifiers 5*y*, 6*y* and 31*y* to 34*y* may be replaced by various types of amplifiers such as a MMIC formed on the semiconductor substrate. In this case, the coupling insulation material may be replaced by a semiconductor material.

Although the coupling conductors 21*aay*, 21*aby*, 21*day*, 21*bby*, 41*aay*, 41*abyu*, 41*bay*, 41*bby*, 41*cay*, 41*cby*, 41*day*, 41*dby*, 41*eay*, 41*eby*, 41*fay*, 41*fby*, 41*gay*, 41*gby*, 41*hay* and 41*hby* and coupling openings 22*ay*, 22*by* and 42*ay* to 42*hy* are respectively formed of a rectangular shape, the shape is not limited to a rectangular shape, provided that openings are formed between the coupling conductors of the directional coupler so that the mode coupling can be electromagnetically developed between each pair of the coupling conductors.

Although the explanation is made with respect to a device having four signal input and output terminals, more than 16 multi terminals may be used in the device of the present invention.

In place of the amplifiers 5*y*, 6*y* and 31*y* and 34*y*, various microwave signal processing devices such as an attenuator, a phase shifter, a modulator and/or a frequency converter may be used. Accordingly, in the present invention by providing at least one of the directional couplers 50*ay* and 50*by* the microwave signal processing device may be provided in the present invention, so that the present invention can be applied to the various types of microwave devices. Accordingly, it is possible to provide microwave devices which are able to process input signals having a good electric property for preventing the interference between the signals propagating in the lines with the microwave devices being small in size, light in weight and capable of easy manufacturing.

In a case where the phase shifters are used in place of the amplifiers 5*y* and 6*y* of FIGS. 15(A) and 15(C), by changing the amount of phase shift in the phase shifters, it is possible to take attenuated microwave signals from the output terminals 2*y* using the input microwave signals at the input terminal 1*y*.

In the present invention, since there are provided one or more directional couplers formed in such a manner that two coupling conductors forming input and output terminals are disposed on both sides of the ground conductor through the substrates so that the coupling conductors can be electromagnetically coupled through openings defined in the ground conductor between the coupling conductors and microwave signal processing device disposed in the front stage or the rear stage of the directional coupler. The coupling conductors of the directional coupler, the microwave signal processing device and various lines for connecting the coupling conductors and the microwave processing device may be formed on both sides of the two substrates that are separated into two parts. Accordingly the size of the microwave device is about ½ of the conventional device and it is possible to provide a light and small sized device. Since the device according to the present invention can be provided without using wire and ribbon coupling conductors to develop the ridge coupling, the interference among the signals can be prevented. Therefore, a microwave device can be provided which is able to process the microwave signal having a good electric property.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A multi-terminal directional coupler device, comprising:

a ground conductor having a top surface, a bottom surface, and a plurality of openings formed therein;

a coupling insulation material formed in said plurality of openings;

first and second dielectric substrates formed on said top and bottom surfaces, respectively;

a plurality of first directional couplers formed by said coupling insulation material in said plurality of openings for electromagnetic coupling signals;

a plurality of pairs of coupling conductors disposed on said first and second dielectric substrates, respectively, said plurality of pairs of coupling conductors being disposed adjacent to said plurality of openings; and a plurality of second branch line couplers disposed on said first and second dielectric substrates, said plurality of second branch line couplers being connected to said plurality of pairs of coupling conductors.

2. A coupler device as claimed in claim 1, wherein said plurality of openings are formed in a rectangular shape and said plurality of pairs of coupling conductors are substantially formed in said rectangular shape.

3. A multi-terminal directional coupler device, comprising:

a ground conductor having a top surface, a bottom surface, and a plurality of openings formed therein;

a coupling insulation material formed in said plurality of openings;

first and second dielectric substrates formed on said top and bottom surfaces, respectively;

a plurality of directional couplers formed by said coupling insulation material over said plurality of openings for electromagnetic coupling signals;

a plurality of pairs of coupling conductors disposed on said first and second dielectric substrates, respectively, said plurality of pairs of coupling conductors being disposed adjacent to said plurality of openings;

a predetermined number of input and output terminals disposed on said first and second dielectric substrates and connected to said plurality of pairs of coupling conductors, said predetermined number of input and output terminals being equal to $2^l$, where l is a natural number greater than or equal to 2, and said plurality of directional couplers are equal to l. $2^{l-1}$, and outputting signals to said predetermined number of output terminals having ½ of the power of signals inputted from said predetermined number of input terminals.

4. A microwave device comprising:

a ground conductor having a top surface, a bottom surface, and a predetermined number of openings formed therein;

a coupling insulation material formed in said predetermined number of openings;

first and second dielectric substrates formed on said top and bottom surfaces, respectively;

directional couplers, of said predetermined number, formed by said coupling material over said predetermined number of openings for electromagnetic coupling signals;

first coupling conductors, of said predetermined number, disposed over said predetermined number of said directional couplers on said first dielectric substrate, said predetermined number of said first coupling conductors being patterned for connecting said directional couplers thereto;

second coupling, of said predetermined number, conductors disposed over said predetermined number of said directional couplers on said second dielectric substrate, said predetermined number of said second coupling conductors being patterned for connecting said directional couplers;

first microwave signal processing means disposed on said first dielectric substrate, an input of said first microwave signal processing means being connected to one of said predetermined number of said first coupling conductors and an output of said first microwave signal processing means being connected to another of said predetermined number of said first coupling conductors; and second microwave signal processing means disposed on said second dielectric substrate, an input of said second microwave signal processing means being connected to one of said predetermined number of said second coupling conductors and an output of said second microwave signal processing means being connected to another of said second coupling conductors.

5. A microwave device as claimed in claim 4, wherein said first and second microwave signal processing means comprise first and second amplifiers.

6. A method for forming a multi-terminal directional coupler device, comprising the steps of:

forming a ground conductor having a top surface and a bottom surface;

forming a predetermined number of openings in said ground conductor;

disposing a coupling insulation material in said predetermined number of openings;

disposing first and second dielectric substrates on said top and bottom surfaces, respectively;

forming directional couplers of said predetermined number corresponding to said coupling insulation material over said predetermined number of openings for electromagnetic coupling signals;

disposing pairs of coupling conductors of said predetermined number on said first and second dielectric substrates, respectively, adjacent to said predetermined number of openings; and connecting said predetermined number of said pairs of coupling conductors on said first and second dielectric substrates, respectively.

* * * * *